US009589508B2

(12) United States Patent
Yang et al.

(10) Patent No.: US 9,589,508 B2
(45) **Date of Patent: *Mar. 7, 2017**

(54) PIXEL CIRCUIT, DISPLAY PANEL, AND DISPLAY DEVICE

(71) Applicant: WUHAN TIANMA MICRO-ELECTRONICS CO., LTD., Wuhan (CN)

(72) Inventors: Sijie Yang, Wuhan (CN); Chao Dai, Wuhan (CN); Tong Wu, Shanghai (CN)

(73) Assignee: WUHAN TIANMA MICRO-ELECTRONICS CO., LTD., Wuhan (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/204,680

(22) Filed: Jul. 7, 2016

(65) Prior Publication Data

US 2016/0321988 A1 Nov. 3, 2016

Related U.S. Application Data

(63) Continuation of application No. 14/557,257, filed on Dec. 1, 2014, now Pat. No. 9,424,776.

(30) Foreign Application Priority Data

Sep. 2, 2014 (CN) ..... 2014 1 0442485

(51) Int. Cl.
*G09G 3/30* (2006.01)
*G09G 3/32* (2016.01)

(52) U.S. Cl.
CPC ..... *G09G 3/3241* (2013.01); *G09G 3/3258* (2013.01); *G09G 2300/0417* (2013.01);
(Continued)

(58) Field of Classification Search
CPC .. G09G 3/3233; G09G 3/3266; G09G 3/3208; G09G 2320/0233;
(Continued)

(56) References Cited

U.S. PATENT DOCUMENTS 7,327,357 B2 * 2/2008 Jeong ..... G09G 3/3233 315/169.1
7,876,292 B2 * 1/2011 Cho ..... G09G 3/3233 315/169.3
(Continued)

FOREIGN PATENT DOCUMENTS

DE 602005002777 T2 4/2008
DE 112008002931 T5 12/2010
(Continued)

*Primary Examiner* — Jennifer Nguyen
(74) *Attorney, Agent, or Firm* — Anova Law Group, PLLC

(57) ABSTRACT

A pixel driving circuit includes a signal loading component, a storage capacitor, a compensation component, a mirror component, and a drive transistor. In a data transmission stage, the signal loading component transmits a received image data signal to the gate of a drive transistor, which is stored in a storage capacitor; and in a threshold voltage compensation stage, the compensation component connects the gate of the drive transistor to the source of the drive transistor so as to generate a drive signal dependent upon the threshold voltage of the drive transistor from the signal stored in the storage capacitor and to drive an organic light emitting diode to emit light, thus eliminating an influence of the threshold voltage of the drive transistor on the current through the organic light emitting diode and preventing the brightness of the organic light emitting diode from varying over its operating period of time.

20 Claims, 13 Drawing Sheets

(52) U.S. Cl.
CPC ..... *G09G 2300/0814* (2013.01); *G09G 2300/0819* (2013.01); *G09G 2300/0842* (2013.01); *G09G 2300/0861* (2013.01); *G09G 2310/0262* (2013.01); *G09G 2320/043* (2013.01); *G09G 2320/045* (2013.01)

(58) Field of Classification Search
CPC ... G09G 2300/0819; G09G 2300/0852; G09G 2300/0866; G09G 2300/043
USPC ..... 345/76, 77, 690; 315/169.3
See application file for complete search history.

(56) References Cited

U.S. PATENT DOCUMENTS

| | | | | |
|---|---|---|---|---|
| 9,424,776 | B2 * | 8/2016 | Yang | G09G 3/3258 |
| 2007/0126663 | A1 * | 6/2007 | Kim | G09G 3/3241 345/76 |
| 2007/0182671 | A1 * | 8/2007 | Nathan | G09G 3/3241 345/76 |
| 2008/0297056 | A1 * | 12/2008 | Hirai | G09G 3/3241 315/169.3 |
| 2011/0141084 | A1 | 6/2011 | Kishi | |

FOREIGN PATENT DOCUMENTS

| | | | |
|---|---|---|---|
| KR | 1020080086128 | A | 9/2008 |
| KR | 1020100011642 | A | 2/2010 |

* cited by examiner

PIXEL CIRCUIT, DISPLAY PANEL, AND DISPLAY DEVICE

CROSS-REFERENCES TO RELATED APPLICATIONS

This application is a continuation-in-part (CIP) application of U.S. patent application Ser. No. 14/557,257, filed on Dec. 1, 2014, which claims priority to Chinese patent application No. 201410442485.X, entitled "PIXEL CIRCUIT, DISPLAY PANEL, AND DISPLAY DEVICE", filed with the State Intellectual Property Office of People's Republic of China on Sep. 2, 2014, the entire contents of which are incorporated herein by reference.

TECHNICAL FIELD

The present invention relates to the field of display technologies, and more particularly to a pixel circuit, a display panel and a display device.

BACKGROUND OF THE INVENTION

Active Matrix Organic Light Emitting Diode (AMOLED) displays have been widely used due to their wide viewing angle, good color contrast effect, high response speed, low cost and other advantages. However, a drift in threshold voltage may result from the problem of non-uniformity of a Thin Film Transistor (TFT) array substrate in a process flow.

As illustrated in FIG. 1, a traditional 2T1C pixel circuit includes a switch transistor T1, a drive transistor T2, a storage capacitor C1 and an Organic Light Emitting Diode (OLED). A scan signal, denoted Scan, is received at the gate of the switch transistor T1, and the scan signal Scan includes a signal on a gate line connected with the pixel circuit. An image data signal, denoted Data, is received at the source (or the drain) of the switch transistor T1, the drain (or the source) of the switch transistor T1 is connected with a first end of the storage capacitor C1, a first drive signal VDD is received at a second end of the storage capacitor C1, the first drive signal VDD is received at the source of the drive transistor T2, the gate of the drive transistor T2 is connected with the first end of the storage capacitor C1, the drain of the drive transistor T2 is connected with a first end of the OLED, and a second drive signal VSS is received at a second end of the drive transistor T2. When a start signal in the scan signal Scan is received at the gate of the switch transistor T1, the switch transistor T1 is turned on, and the image data signal Data received at the source (or the drain) of the switch transistor T1 is transferred to the drain (or the source) of the switch transistor T1 and stored in the storage capacitor C1, wherein the drive transistor T2 is controlled by the image data signal Data together with the first drive signal VDD to operate so that the OLED is driven by the current at the drain of the drive transistor T2 to emit light. In such a 2T1C pixel circuit, the current at the drain to drive the OLED to emit light is dependent upon the threshold voltage of the drive transistor T2, and with a long operating time a drift in threshold voltage of the drive transistor T2 may result from the characteristic of the transistor per se, thereby varying a current flowing through the organic light emitting diodes in an array of pixel circuits, and imposing a direct influence upon the brightness of the light emitting diodes, which will be more apparent in a high-power light emitting diode display element.

In summary, a drift in threshold voltage of a drive transistor in a pixel element over its operating period of time may have the same OLED driven by varying current to emit light upon reception of the same image data signal during different periods of time so that the brightness of the OLED will vary over its operating period of time.

BRIEF SUMMARY OF THE INVENTION

Embodiments of the present invention provide a pixel circuit, a display panel and a display device.

An embodiment of the present invention provides a pixel circuit for driving an organic light emitting diode. The pixel circuit includes a signal loading component, a storage capacitor, a compensation component, a mirror component and a drive transistor, wherein the signal loading component is configured to transmit a received image data signal to the gate of the drive transistor in a data transmission stage; the storage capacitor is configured to store the signal at the gate of the drive transistor; the drive transistor is configured to generate the current at the drain of the drive transistor according to the difference between the signal at the gate of the drive transistor and a signal on the source of the drive transistor in a light emission stage; the compensation component is configured to connect the gate of the drive transistor to the source of the drive transistor in a threshold voltage compensation stage so as to generate a drive signal from the image data signal stored in the storage capacitor in the data transmission stage; and the mirror component is configured to mirror the current, generated by the drive transistor, at the drain thereof onto the organic light emitting diode in the light emission stage, so that the organic light emitting diode emits light with the difference in voltage between a first power supply signal and a second power supply signal.

Another embodiment of the present invention provides a display panel including a pixel circuit according to the embodiment of the present invention.

Another embodiment of the present invention provides a display device including the display panel according to the embodiment of the present invention.

DETAILED DESCRIPTION OF THE PREFERRED EMBODIMENTS

Embodiments of the present invention provide a pixel circuit, a display panel and a display device, wherein in a data transmission stage, a signal loading component transmits a received image data signal to the gate of a drive transistor, and the signal is stored in a storage capacitor, and in a threshold voltage compensation stage, a compensation component connects the gate of the drive transistor to the source of the drive transistor to fetch the threshold voltage of the drive transistor so as to generate a drive signal dependent upon the threshold voltage of the drive transistor from the image data signal stored in the storage capacitor in the data transmission stage and to further drive an organic light emitting diode by the drive signal to emit light, thus eliminating an influence of the threshold voltage of the drive transistor on drive current flowing through the organic light emitting diode and preventing the brightness of the organic light emitting diode from varying over its operating period of time.

Particular implementations of a pixel circuit, a display panel and a display device according to embodiments of the present invention will be described below with reference to the drawings.

An embodiment of the present invention provides a pixel circuit for driving an organic light emitting diode, the pixel circuit includes a signal loading component, a storage capacitor, a compensation component, a mirror component and a drive transistor.

The signal loading component is configured to transmit a received image data signal to the gate of the drive transistor in a data transmission stage.

The storage capacitor is configured to store the signal at the gate of the drive transistor.

The drive transistor is configured to generate the current at the drain thereof according to the difference between the signal at the gate of the drive transistor and a signal on the source of the drive transistor in a light emission stage.

The compensation component is configured to connect the gate of the drive transistor to the source of the drive transistor in a threshold voltage compensation stage so as to generate a drive signal from the image data signal stored in the storage capacitor in the data transmission stage.

The mirror component is configured to mirror the current, generated by the drive transistor, at the drain of the drive transistor onto the organic light emitting diode in the light emission stage so that the organic light emitting diode emits light with the difference in voltage between a first power supply signal and a second power supply signal.

Figure 1:
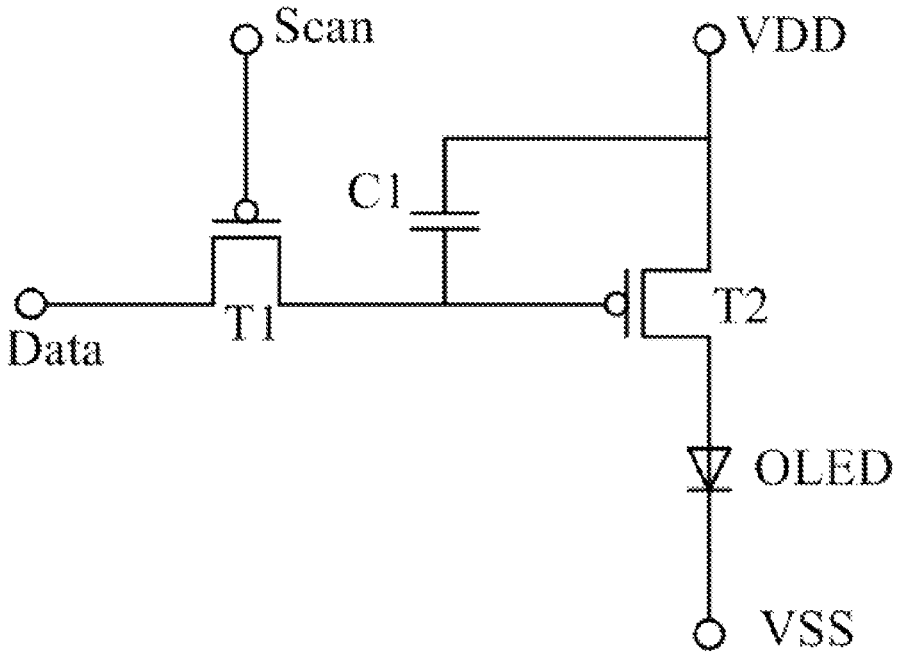
FIG. 1 (Prior Art)
FIG. 1 is a schematic structural diagram of a pixel circuit in the prior art.
Figure 2:
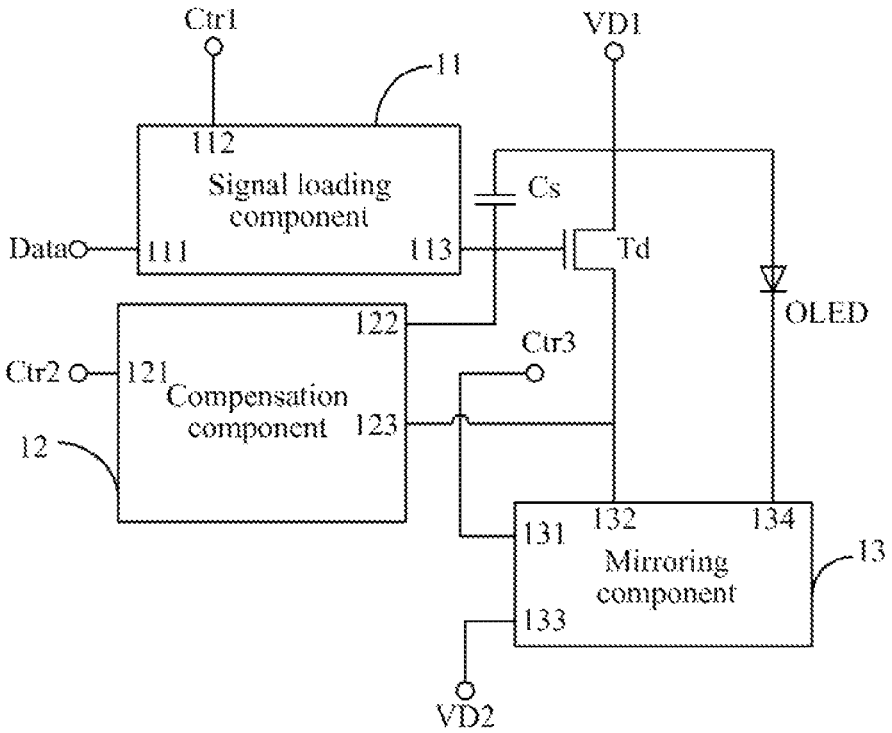
FIG. 2 is a simplified block diagram of a pixel circuit according to a first embodiment of the present invention.
Figure 3:
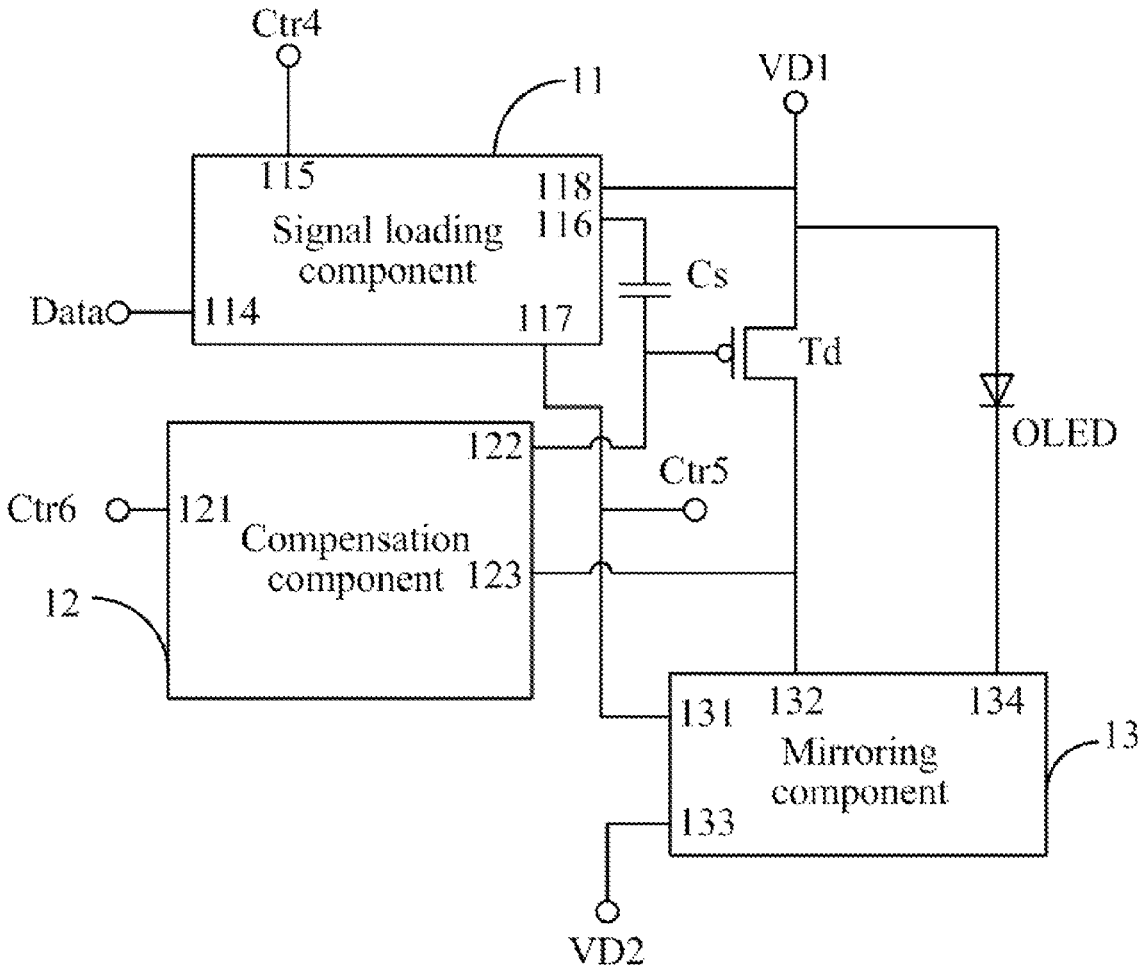
FIG. 3 is a simplified block diagram of a pixel circuit according to a second embodiment of the present invention.

The pixel circuit according to the embodiment of the present invention may be embodied in a circuit structure illustrated in FIG. 2 or may be embodied in a circuit structure illustrated in FIG. 3, wherein when a pixel circuit according to the embodiment of the present invention is embodied in the circuit structure illustrated in FIG. 2, all of a transistor in the signal loading component 11, a transistor in the compensation component 12, a transistor in the mirror component 13, and the drive transistor Td, in the pixel circuit are n-type transistors; and when a pixel circuit according to an embodiment of the present invention is embodied in the circuit structure illustrated in FIG. 3, all of a transistor in the signal loading component 11, a transistor in the compensation component 12, a transistor in the mirror component 13, and the drive transistor Td, in the pixel circuit are p-type transistors.

When the pixel circuit according to the embodiment of the present invention is embodied in the circuit structure illustrated in FIG. 2, the image data signal Data is received at a first end 111 of the signal loading component 11, a first control signal Ctr1 is received at a second end 112 of the signal loading component 11, and a third end 113 of the signal loading component 11 is connected with the gate of the drive transistor Td; a second control signal Ctr2 is received at a first end 121 of the compensation component 12, a second end 122 of the compensation component 12 is connected with the gate of the drive transistor Td, and a third end 123 of the compensation component 12 is connected with the source of the drive transistor Td; a third control signal Ctr3 is received at a first end 131 of the mirror component 13, a second end 132 of the mirror component 13 is connected with the source of the drive transistor Td, the second power supply signal VD2 is received at a third end 133 of the mirror component 132, and a fourth end 134 of the mirror component 13 is connected with the cathode of the Organic Light Emitting Diode (OLED); the first power supply signal VD1 is received at the anode of the Organic Light Emitting Diode (OLED), and the first power supply signal VD1 is received at the drain of the drive transistor Td; one end of the storage capacitor Cs is connected with the drain of the drive transistor Td, and the other end of the storage capacitor Cs is connected with the gate of the drive transistor Td; and the signal loading component 11 is configured to connect the first end 111 of the signal loading component 11 to the third end 113 of the signal loading component 11 in the data transmission stage so that the received image data signal Data is transmitted to the gate of the drive transistor Td in the data transmission stage, the compensation component 12 is configured to connect the second end 122 of the compensation component 12 to the third end 123 of the compensation component 12 in the threshold voltage compensation stage so as to generate the drive signal from the image data signal stored in the storage capacitor, and the mirror component 13 is configured to connect the second end 132 of the mirror component 13 to the third end 133 of the mirror component 13 in the light emission stage.

When the pixel circuit according to the embodiment of the present invention is embodied in the circuit structure illustrated in FIG. 2, the voltage at the gate of the drive transistor Td is the voltage Vdata of the image data signal Data at the end of the data transmission stage, and the voltage at the gate of the drive transistor Td is Vdata+Vth at the end of the threshold voltage compensation stage; and the drive transistor Td in FIG. 2 is an n-type transistor, so the threshold voltage Vth of the drive transistor Td is above zero. The drive transistor Td operates in a saturated region in the light emission stage so that the current at the drain thereof is generated from the difference in voltage between the gate and drain of the drive transistor Td, so the value of the current at the drain Id of the drive transistor Td may be calculated via the equation of a current characteristic of a transistor operating in a saturated region: $I_d=\frac{1}{2}k(V_{gs}-Vth)^2$, wherein k is dependent upon a structural parameter of the drive transistor Td, Vth represents the threshold voltage of the drive transistor Td, Vgs represents the difference between the voltage Vg at the gate of the drive transistor Td and the voltage Vs at the source of the drive transistor Td, that is, Vgs=Vg−Vs=Vdata+Vth−Vd1, and Vd1 represents the voltage of the first power supply signal VD1, so the current at the drain Id of the drive transistor Td is $I_d=\frac{1}{2}k(Vdata-Vd1)^2$. It can be seen that the current at the drain $I_d$ of the drive transistor Td will not vary with the threshold voltage Vth of the drive transistor Td, and the mirror component will mirror the current at the drain $I_d$ of the drive transistor Td onto the organic light emitting diode to drive the organic light emitting diode emit light, that is, the threshold voltage Vth of the drive transistor Td will have no influence on the drive current flowing through the organic light emitting diode, thus preventing the brightness of the organic light emitting diode from varying over its operating period of time.

When the pixel circuit according to the embodiment of the present invention is embodied in the circuit structure illustrated in FIG. 3, the image data signal Data is received at a fourth end 114 of the signal loading component 11, a fourth control signal Ctr4 is received at a fifth end 115 of the signal loading component 11, a sixth end 116 of the signal loading component 11 is connected with one end of the storage capacitor Cs, a fifth control signal Ctr5 is received at a seventh end 117 of the signal loading component 11, an eighth end 118 of the signal loading component 11 is connected with the drain of the drive transistor Td, and the other end of the storage capacitor Cs is connected with the gate of the drive transistor Td; a sixth control signal Ctr6 is received at a first end 121 of the compensation component 12, a second end 122 of the compensation component 12 is connected with the gate of the drive transistor Td, and a third end 123 of the compensation component 12 is connected with the source of the drive transistor Td; the fifth control signal Ctr5 is received at a first end 131 of the mirror component 13, a second end 132 of the mirror component 13 is connected with the source of the drive transistor Td, the second power supply signal VD2 is received at a third end 133 of the mirror component 132, and a fourth end 134 of the mirror component 13 is connected with the cathode of the Organic Light Emitting Diode (OLED); the first power supply signal VD1 is received at the anode of the Organic Light Emitting Diode (OLED), and the first power supply signal VD1 is received at the drain of the drive transistor Td; and the signal loading component 11 is configured to connect the fourth end 114 of the signal loading component 11 to the sixth end 116 of the signal loading component 11 in the data transmission stage and to disconnect the fourth end 114 of the signal loading component 11 from the sixth end 116 of the signal loading component 11 in both the threshold voltage compensation stage and the light emission stage; and to disconnect the sixth end 116 of the signal loading component 11 from the eighth end 118 of the signal loading component 11 in both the data transmission stage and the threshold voltage compensation stage, and to connect the sixth end 116 of the signal loading component 11 to the eighth end 118 of the signal loading component 11 in the light emission stage; the compensation component 12 is configured to connect the second end 122 of the compensation component 12 to the third end 123 of the compensation component 12 in the threshold voltage compensation stage so as to generate the drive signal from the image data signal stored in the storage capacitor Cs; and the mirror component 13 is configured to connect the second end 132 of the mirror component 13 to the third end 133 of the mirror component 13 in the light emission stage.

The signal loading component 11 connects the fourth end 114 of the signal loading component 11 to the sixth end 116 of the signal loading component 11, and disconnects the sixth end 116 of the signal loading component 11 from the eight end 118 of the signal loading component 11 in the data transmission stage, so that in the data transmission stage, the signal loading component 11 may transmit the received image data signal Data to one end of the storage capacitor Cs, i.e., the end of the storage capacitor Cs connected with the sixth end 116 of the signal loading component 11, and since the end of the storage capacitor Cs connected with the gate of the drive transistor Td floats, the variation in voltage at the end of the storage capacitor Cs connected with the sixth end 116 of the signal loading component 11 may be coupled to the end of the storage capacitor Cs connected with the gate of the drive transistor Td, so the signal loading component 11 may transmit the received image data signal Data to the gate of the drive transistor Td in the data transmission stage.

When the pixel circuit according to the embodiment of the present invention is embodied in the circuit structure illustrated in FIG. 3, the voltage at the gate of the drive transistor Td is the voltage Vdata of the image data signal Data at the end of the data transmission stage, and the voltage at the gate of the drive transistor Td is Vdata+Vth at the end of the threshold voltage compensation stage; and the drive transistor Td in FIG. 3 is a p-type transistor, so the threshold voltage Vth of the drive transistor Td is below zero. In the light emission stage, the sixth end 116 of the signal loading component 11 is connected with the eighth end 118 of the signal loading component 11, and the drive transistor Td operates in a saturated region, so that the current at the drain of the drive transistor Td is generated from the difference in voltage between the gate and source of the drive transistor Td, so the value of the current at the drain $I_d$ of the drive transistor Td may be calculated via the equation of a current characteristic of a transistor operating in a saturated region: $I_d=\frac{1}{2}k(V_{gs}-Vth)^2$, wherein k is dependent upon a structural parameter of the drive transistor Td, Vth represents the threshold voltage of the drive transistor Td, $V_{gs}$ represents the difference between the voltage $V_g$ at the gate of the drive transistor Td and the voltage $V_s$ at the source of the drive transistor Td, that is, $V_{gs}=V_g-V_s$=Vdata+Vth−Vd1, and Vd1 represents the voltage of the first power supply signal VD1, so the current at the drain $I_d$ of the drive transistor Td is $I_d=\frac{1}{2}k(Vdata-Vd1)^2$. It can be seen that the current at the drain $I_d$ of the drive transistor Td will not vary with the threshold voltage Vth of the drive transistor Td, and the mirror component will mirror the current at the drain $I_d$ of the drive transistor Td onto the organic light emitting diode to drive the organic light emitting diode emit light, that is, the threshold voltage Vth of the drive transistor Td will have no influence on the drive current flowing through the organic light emitting diode, thus preventing the brightness of the organic light emitting diode from varying over its operating period of time.

Furthermore, when all of transistors in the signal loading component, the compensation component and the mirror component in the pixel circuit according to the embodiment of the present invention are n-type transistors, and the drive transistor is an n-type transistor, the pixel circuit according to the embodiment of the present invention is as illustrated in any one of FIG. 4 to FIG. 7, wherein the signal loading component 11 includes a first transistor T1; a first terminal of the first transistor T1 is the first end 111 of the signal loading component 11, the gate of the first transistor T1 is the second end 112 of the signal loading component 11, the first control signal Ctr1 is received at the gate of the first transistor T1, and a second terminal of the first transistor T1 is the third end 113 of the signal loading component 11; and the first transistor T1 is turned on in the data transmission stage and turned off in the threshold voltage compensation stage and the light emission stage.

Figure 4:
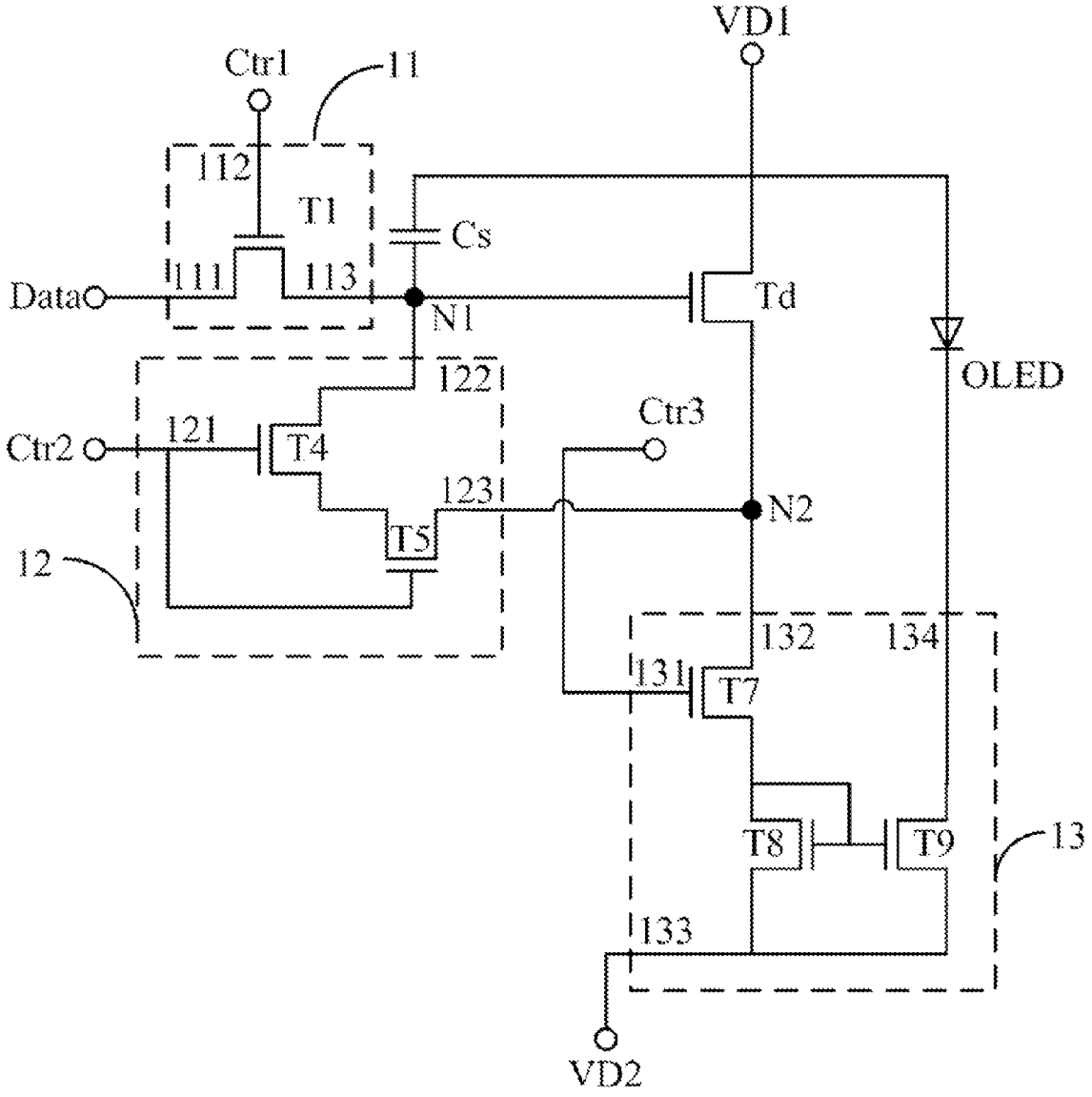
FIG. 4 is a simplified circuit diagram of a pixel circuit according to a third embodiment of the present invention.
Figure 6:
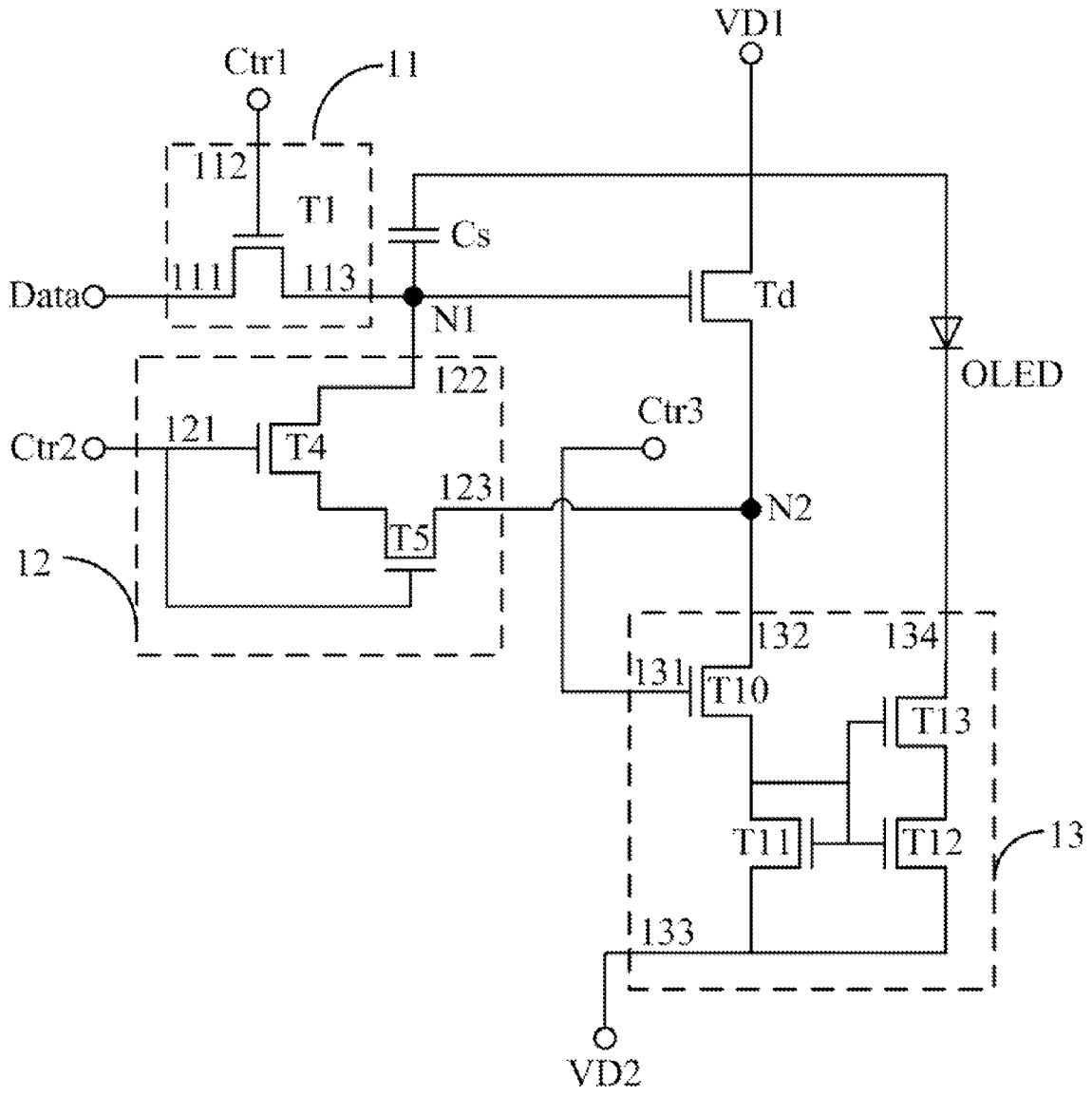
FIG. 6 is a simplified circuit diagram of a pixel circuit according to a fifth embodiment of the present invention.

As illustrated in FIG. 4 or FIG. 6, when all the transistors in the signal loading component, the compensation component and the mirror component in the pixel circuit according to the embodiment of the present invention are n-type transistors, and the drive transistor is an n-type transistor, the compensation component 12 in the pixel circuit according to the embodiment of the present invention includes a fourth transistor T4 and a fifth transistor T5, wherein the gate of the fourth transistor T4 is the first end 121 of the compensation component 12, the second control signal Ctr2 is received at the first end 121, the first terminal of the fourth transistor T4 is the second end 122 of the compensation component 12, and the second terminal of the fourth transistor T4 is a first terminal of the fifth transistor T5; the gate of the fifth transistor T5 is the first end 121 of the compensation component 12, the second control signal Ctr2 is received at the first end 121, and a second terminal of the fifth transistor T5 is the third end 123 of the compensation component 12; and both the fourth transistor T4 and the fifth transistor T5 are configured to be turned on in the threshold voltage compensation stage and to be turned off in the data transmission stage and the light emission stage.

Since there is a gate-source parasitic capacitance and a gate-drain parasitic capacitance of a transistor per se and there is also a parasitic capacitance of overlapping line segments in the pixel circuit, when the respective control signals change, a potential at the gate of the drive transistor Td may change due to a coupling effect of the parasitic capacitance, thus degrading the effect of compensation in the threshold voltage compensation stage.

Figure 5:
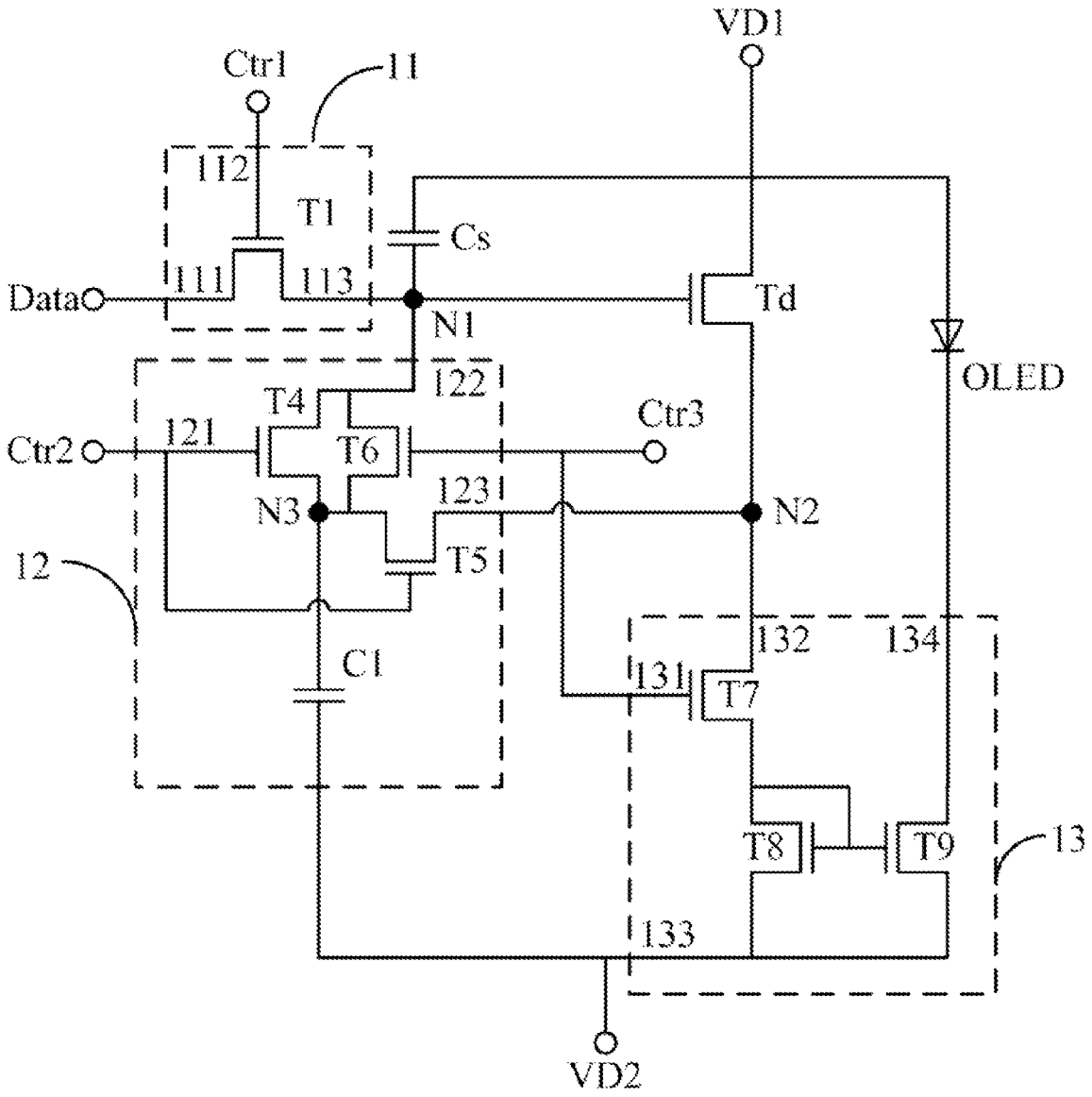
FIG. 5 is a simplified circuit diagram of a pixel circuit according to a fourth embodiment of the present invention.
Figure 7:
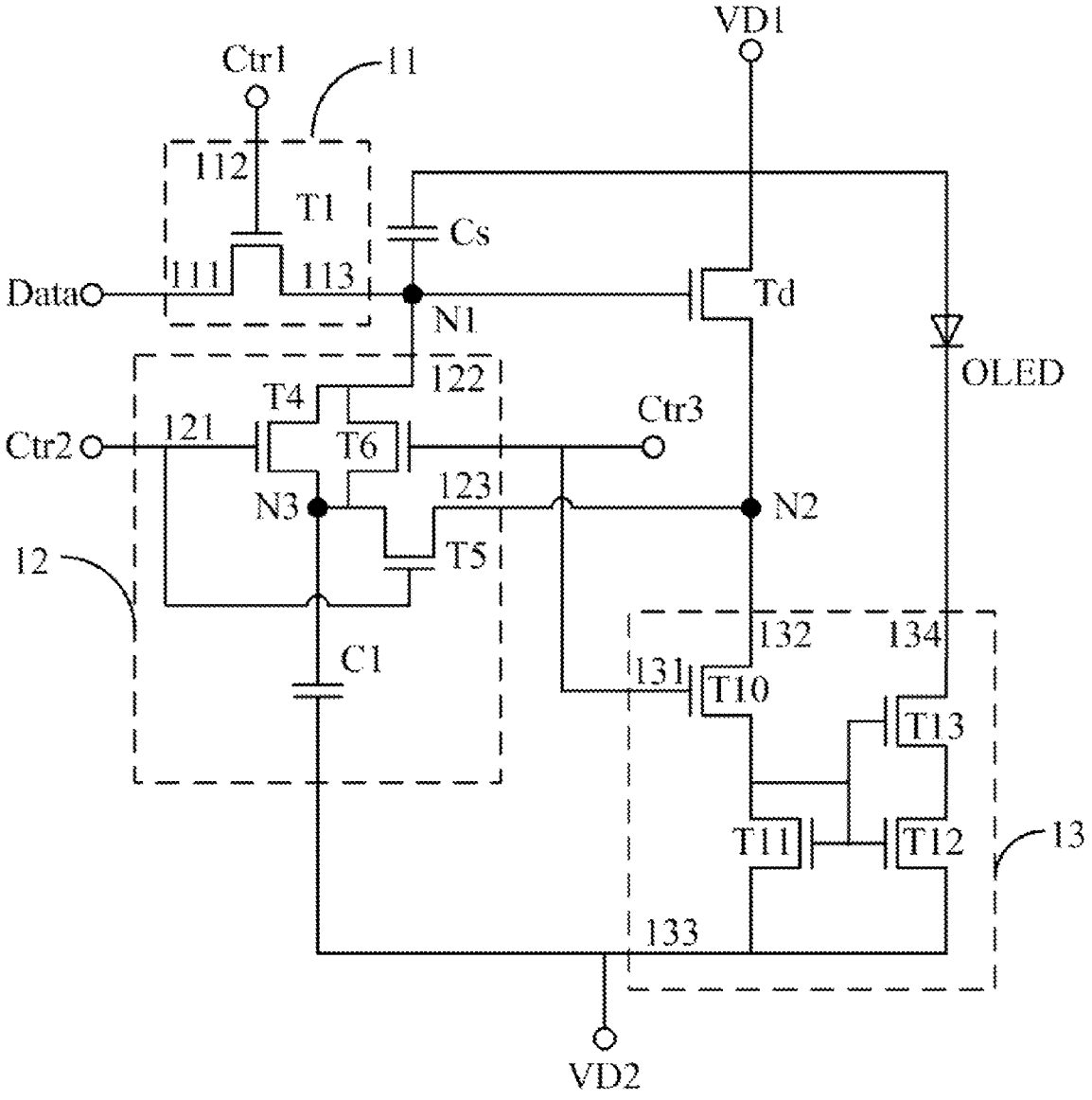
FIG. 7 is a simplified circuit diagram of a pixel circuit according to a sixth embodiment of the present invention.

Thus, preferably as illustrated in FIG. 5 or FIG. 7, when all the transistors in the signal loading component, the compensation component and the mirror component in the pixel circuit according to the embodiment of the present invention are n-type transistors, and the drive transistor is an n-type transistor, the compensation component 12 in the pixel circuit according to the embodiment of the present invention further includes a sixth transistor T6 and a first capacitor C1, wherein both a first terminal of the sixth transistor T6 and one end of the first capacitor C1 are connected with the second terminal of the fourth transistor T4; the second power supply signal VD2 is received at the other end of the first capacitor C1; a signal received at the gate of the sixth transistor T6 is the same as the signal received at the first end 131 of the mirror component 13, that is, the third control signal Ctr3 is received at the gate of the sixth transistor T6, and a second terminal of the sixth transistor T6 is connected with the gate of the drive transistor Td; the sixth transistor T6 is turned on in the light emission stage and turned off in both the data transmission stage and the threshold voltage compensation stage; and the first capacitor C1 is charged in the threshold voltage compensation stage so that the drive transistor Td generates the drive signal from the stored image data signal.

After the sixth transistor T6 and the first capacitor C1 are added to the compensation component, in the threshold voltage compensation stage, the second power supply signal VD2 is received at one end of the first capacitor C1, and the voltage of the second power supply signal VD2 is substantially stable, so that the potential at the gate of the drive transistor Td may be locked effectively, thus, the potential at the gate of the drive transistor Td will not be easily changed with the variation of the respective control signals, and further make the compensated potential at the gate of the drive transistor Td be closer to a preset potential, i.e., Vdata+Vth.

Furthermore as illustrated in FIG. 4 or FIG. 5, when all the transistors in the signal loading component, the compensation component and the mirror component in the pixel circuit according to the embodiment of the present invention are n-type transistors, and the drive transistor is an n-type transistor, the mirror component in the pixel circuit according to the embodiment of the present invention includes a seventh transistor T7, an eighth transistor T8 and a ninth transistor T9, wherein a first terminal of the seventh transistor T7 is the second end 132 of the mirror component 13, the gate of the seventh transistor T7 is the first end 131 of the mirror component 13, the third control signal Ctr3 is received at the first end 131, and a second terminal of the seventh transistor T7 is connected respectively with a first terminal of the eighth transistor T8, the gate of the eighth transistor T8 and the gate of the ninth transistor T9; a second terminal of the eighth transistor T8 is the third end 133 of the mirror component 13; and a first terminal of the ninth transistor T9 is the fourth end 134 of the mirror component 13, and a second terminal of the ninth transistor T9 is the third end 133 of the mirror component 13.

At this time, after the seventh transistor T7 is turned on, the current flowing through the eighth transistor T8 is the same as the current flowing through the ninth transistor T9 when the parameter of the eighth transistor T8 is the same as that of the ninth transistor T9, so the mirror component may mirror the current at the drain of the drive transistor Td onto the organic light emitting diode to drive the Organic Light Emitting Diode (OLED) to emit light.

Preferably, when all the transistors in the signal loading component, the compensation component and the mirror component in the pixel circuit according to the embodiment of the present invention are n-type transistors, and the drive transistor is an n-type transistor, the mirror component in the pixel circuit according to the embodiment of the present invention is further configured to perform negative feedback control on the current flowing through the organic light emitting diode to stabilize the current flowing through the organic light emitting diode.

At this time, as illustrated in FIG. 6 or FIG. 7, the mirror component in the pixel circuit according to the embodiment of the present invention includes a tenth transistor T10, an eleventh transistor T11, a twelfth transistor T12 and a thirteenth transistor T13, wherein a first terminal of the tenth transistor T10 is the second end 132 of the mirror component 13, the gate of the tenth transistor T10 is the first end 131 of the mirror component 13, the third control signal Ctr3 is received at the first end 131, and a second terminal of the tenth transistor T10 is connected respectively with a first terminal of the eleventh transistor T11, the gate of the eleventh transistor T11, the gate of the twelfth transistor T12 and the gate of the thirteenth transistor T13; a second terminal of the eleventh transistor T11 is the third end 133 of the mirror component 13; and a first terminal of the twelfth transistor T12 is connected with a first terminal of the thirteenth transistor T13, a second terminal of the twelfth transistor T12 is the third end 133 of the mirror component 13, and a second terminal of the thirteenth transistor T13 is the fourth end 134 of the mirror component 13.

In FIG. 6 or FIG. 7, when the tenth transistor T10 is turned on, the eleventh transistor T11 operates in a linear region as an active resistor, and when the current at the drain $I_d$ of the drive transistor Td is constant, the drain-source current $I_{ds10}$ of the tenth transistor T10 is constant, and the drain-source current $I_{ds11}$ of the eleventh transistor T11 is equal to $I_{ds10}$, and the eleventh transistor T11 is an active resistor, so the drain-source difference in voltage $V_{ds10}$ of the eleventh transistor T11 $V_{ds11}=V_{g113}+V_{ds12}$ is constant, wherein $V_{g113}$ represents the difference in voltage between the gate of the thirteen transistor T13 and the first terminal of the thirteen transistor T13, and $V_{ds12}$ represents the source-drain difference in voltage of the twelfth transistor T12; and if the current flowing through the Organic Light Emitting Diode (OLED) raises, then the current flowing through the source and the drain of the thirteen transistor T13 raises, and the current flowing through the source and the drain of the twelfth transistor T12 raises, and when the current flowing through the source and the drain of the twelfth transistor T12 raises, the source-drain difference in voltage $V_{ds12}$ across the twelfth transistor T12 raises, and since the drain-source difference in voltage $V_{ds11}$ of the eleventh transistor T11 is constant, the difference in voltage $V_{g113}$ between the gate of the thirteen transistor T13 and the first terminal of the thirteen transistor T13 drops, and according to the characteristic of a transistor operating in a saturated region, when the difference in voltage between the gate of the thirteen transistor T13 and the first terminal of the thirteen transistor T13 is above the threshold voltage of the thirteen transistor T13, the current on the second terminal of the thirteen transistor T13 drops with the dropping difference in voltage $V_{g113}$ between the gate of the thirteen transistor T13 and the first terminal of the thirteen transistor T13, that is, the current flowing through the Organic Light Emitting Diode (OLED) also drops. Similarly, if the current flowing through the Organic Light Emitting Diode (OLED) drops, then the current flowing through the source and the drain of the thirteen transistor T13 drops, and the current flowing through the source and the drain of the twelfth transistor T12 drops, and when the current flowing through the source and the drain of the twelfth transistor T12 drops, the source-drain difference in voltage $V_{ds12}$ across the twelfth transistor T12 drops, and since the drain-source difference in voltage $V_{ds11}$ of the eleventh transistor T11 is constant, the difference in voltage $V_{g113}$ between the gate of the thirteen transistor T13 and the first terminal of the thirteen transistor T13 raises, and as per the characteristic of a transistor operating in a saturated region, when the difference in voltage between the gate of the thirteen transistor T13 and the first terminal of the thirteen transistor T13 is above the threshold voltage of the thirteen transistor T13, the current on the second terminal of the thirteen transistor T13 raises with the raising difference in voltage $V_{g113}$ between the gate of the thirteen transistor T13 and the first terminal of the thirteen transistor T13, that is, the current flowing through the Organic Light Emitting Diode (OLED) also raises. Thus the mirror component 13 in FIG. 6 or FIG. 7 may stabilize the current flowing through the Organic Light Emitting Diode (OLED).

The first terminal of any one of the eleventh transistor T11, the twelfth transistor T12 and the thirteenth transistor T13 in FIG. 6 or FIG. 7 may be the source (or the drain) of the transistor, and the second terminal of the transistor may be the drain (or the source) of the transistor. If the source of the transistor is the first pole, then the drain of the transistor is the second pole; and if the drain of the transistor is the first pole, then the source of the transistor is the second pole.

All the first transistor T1, the fourth transistor T4, the fifth transistor T5, the sixth transistor T6, the seventh transistor T7, the eighth transistor T8, the ninth transistor T9, the tenth transistor T10, the eleventh transistor T11, the twelfth transistor T12, the thirteenth transistor T13 and the drive transistor Td in the pixel circuit illustrated in FIG. 4, FIG. 5, FIG. 6 and FIG. 7 are n-type transistors.

Figure 8:
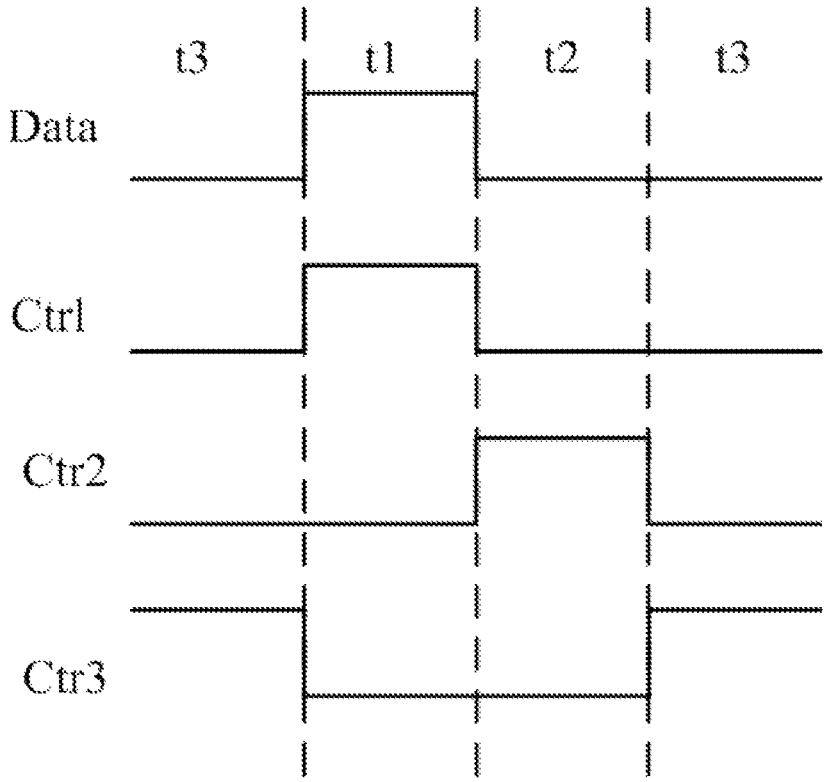
FIG. 8 is an operational timing diagram of the pixel circuits illustrated in FIG. 4 to FIG. 7.

FIG. 8 illustrates an operating timing of the pixel circuit illustrated in FIG. 4, FIG. 5, FIG. 6 and FIG. 7, wherein in the data transmission stage t1, the first control signal Ctr1 is at a high level, so the first transistor T1 is turned on, so that the image data signal Data is transmitted to the gate of the drive transistor Td and stored in the storage capacitor Cs, and the voltage at the first node N1 is Vdata, i.e., the voltage of the image data signal Data; the second control signal Ctr2 is at a low level, so both the fourth transistor T4 and the fifth transistor T5 are turned off; and the third control signal Ctr3 is at a low level, so the sixth transistor T6 in FIG. 5 and FIG. 7 is turned off, the seventh transistor T7 in FIG. 4 and FIG. 5 is turned off, and the tenth transistor T10 in FIG. 6 and FIG. 7 is turned off.

In the threshold voltage compensation stage t2, the first control signal Ctr1 is at a low level, so the first transistor T1 is turned off; the second control signal Ctr2 is at a high level, so both the fourth transistor T4 and the fifth transistor T5 are turned on, so that the gate of the drive transistor Td is connected to the source of the drive transistor Td, and the voltage at the first node N1, the voltage at the second node N2 and the voltage at the third node N3 are equal and are all equal to Vdata+Vth, wherein Vth represents the threshold voltage of the drive transistor, and the third control signal Ctr3 is at a low level, so the sixth transistor T6 in FIG. 5 and FIG. 7 is turned off, the seventh transistor T7 in FIG. 4 and FIG. 5 is turned off, and the tenth transistor T10 in FIG. 6 and FIG. 7 is turned off.

In the light emission stage t3, the first control signal Ctr1 is at a low level, so the first transistor T1 is turned off; the second control signal Ctr2 is at a low level, so both the fourth transistor T4 and the fifth transistor T5 are turned off; and the third control signal Ctr3 is at a high level, so the seventh transistor T7 in FIG. 4 and FIG. 5 is turned on, the tenth transistor T10 in FIG. 6 and FIG. 7 is turned on, the mirror component 13 starts to operate, and the sixth transistor T6 in FIG. 5 and FIG. 7 is turned on, so that the Organic Light Emitting Diode (OLED) emits light.

Figure 9:
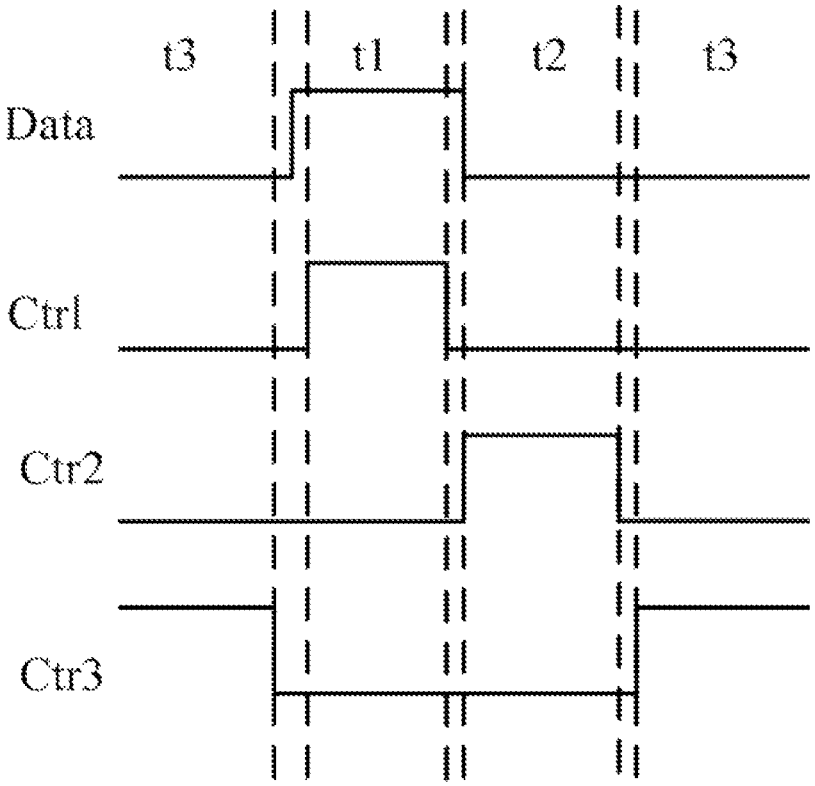
FIG. 9 is an operational timing diagram of the pixel circuits illustrated in FIG. 4 to FIG. 7.

Of course, the operating timing of the pixel circuit illustrated in FIG. 4, FIG. 5, FIG. 6 and FIG. 7 may alternatively be as illustrated in FIG. 9, wherein the first control signal Ctr1 will not be changed to a high level until the third control signal Ctr3 is changed to a low level, so that the Organic Light Emitting Diode (OLED) may be ensured not to transmit the current frame of image data signal to the gate of the drive transistor Td until it stops from emitting light. In FIG. 9, the first control signal Ctr1 will not be changed to a high level until the image data signal becomes the current frame of image data, so that the current frame of image data signal may be ensured not to be transmitted to the gate of the drive transistor Td until it becomes stable; moreover, the second control signal Ctr2 will not be changed to a high level until the first control signal Ctr1 is changed to a low level, so that threshold voltage compensation may be ensured not to be performed until the first transistor T1 is turned off, and thus the first transistor T1 may be prevented from transmitting the signal to the gate of the drive transistor Td during threshold voltage compensation; and lastly, the third control signal Ctr3 will not be changed to a high level until the second control signal Ctr2 is changed to a low level, so that the gate of the drive transistor Td may be ensured to be disconnected from the source of the drive transistor Td when the Organic Light Emitting Diode (OLED) is driven to emit light.

Furthermore, when all the transistors in the signal loading component, the compensation component and the mirror component in the pixel circuit according to the embodiment of the present invention are p-type transistors, and the drive transistor is a p-type transistor, the pixel circuit according to the embodiment of the present invention is as illustrated in any one of FIG. 10 to FIG. 13, and the signal loading component 11 includes a second transistor T2 and a third transistor T3, wherein a first terminal of the second transistor T2 is the fourth end 114 of the signal loading component 11, the gate of the second transistor T2 is the fifth end 115 of the signal loading component 11, the fourth control signal Ctr4 is received at the fifth end 115, and the second terminal of the second transistor T2 is the sixth end 116 of the signal loading component 11; and a first terminal of the third transistor T3 is the sixth end 116 of the signal loading component 11, the gate of the third transistor T3 is the seventh end 117 of the signal loading component 11, the fifth control signal Ctr5 is received at the seventh end 117, and a second terminal of the third transistor T3 is the eighth end 118 of the signal loading component 11; and the second transistor T2 is turned on in the data transmission stage and turned off in both the threshold voltage compensation stage and the light emission stage, and the third transistor T3 is turned on in the light emission stage and turned off in the data transmission stage and the threshold voltage compensation stage.

The second transistor T2 is turned on and the third transistor T3 is turned off in the data transmission stage, so in the data transmission stage, the second transistor T2 may transmit the received image data signal Data to one end of the storage capacitor Cs, i.e., the end of the storage capacitor Cs connected with the second terminal of the second transistor T2, and since the end of the storage capacitor Cs connected with the gate of the drive transistor Td floats, according to the coupling behavior of a capacitor, the variation in voltage at the end of the storage capacitor Cs connected with the second terminal of the second transistor T2 may be coupled to the end of the storage capacitor Cs connected with the gate of the drive transistor Td, so that the signal loading component 11 may transmit the received image data signal Data to the gate of the drive transistor Td in the data transmission stage.

Figure 10:
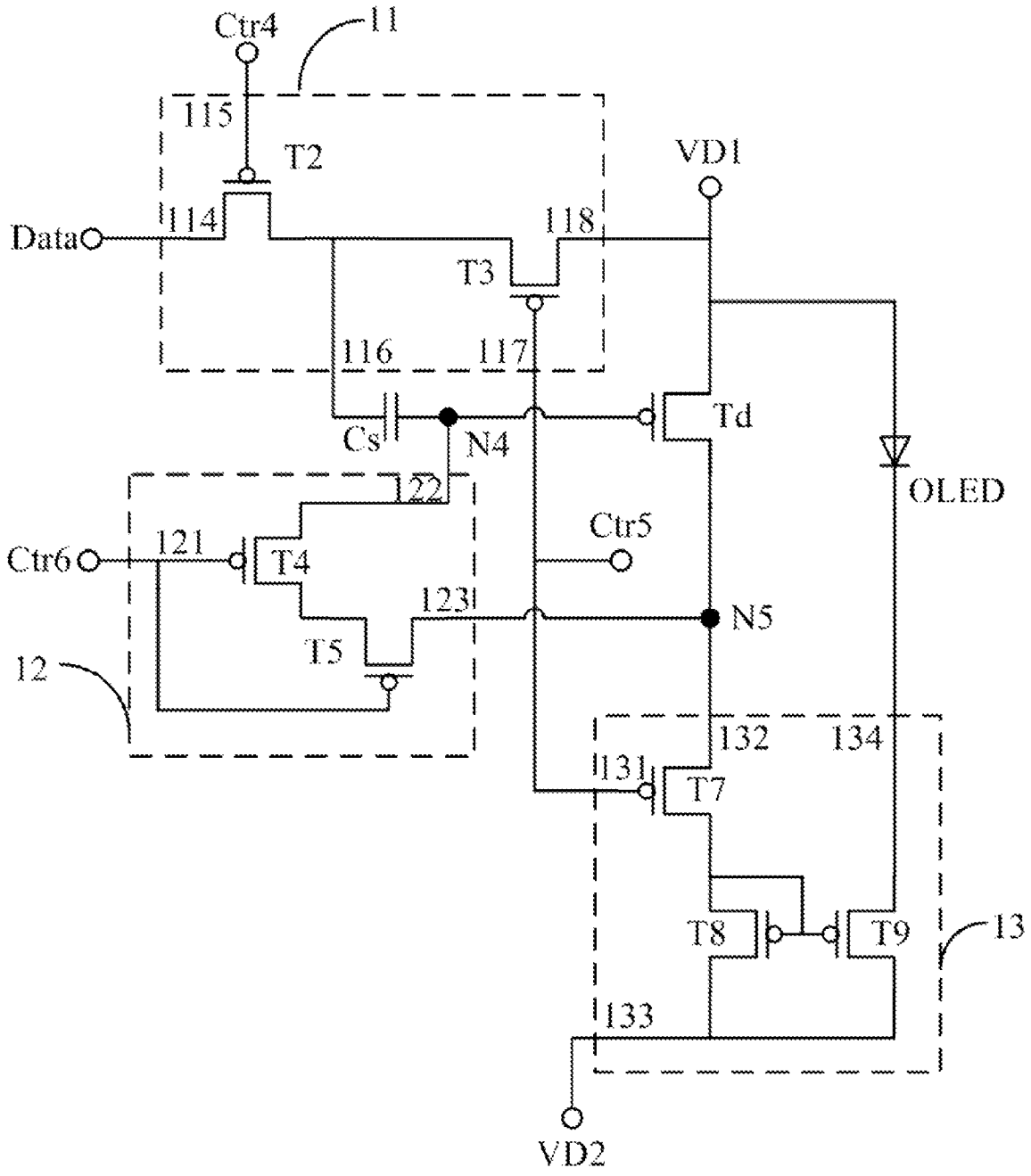
FIG. 10 is a simplified circuit diagram of a pixel circuit according to a seventh embodiment of the present invention.
Figure 12:
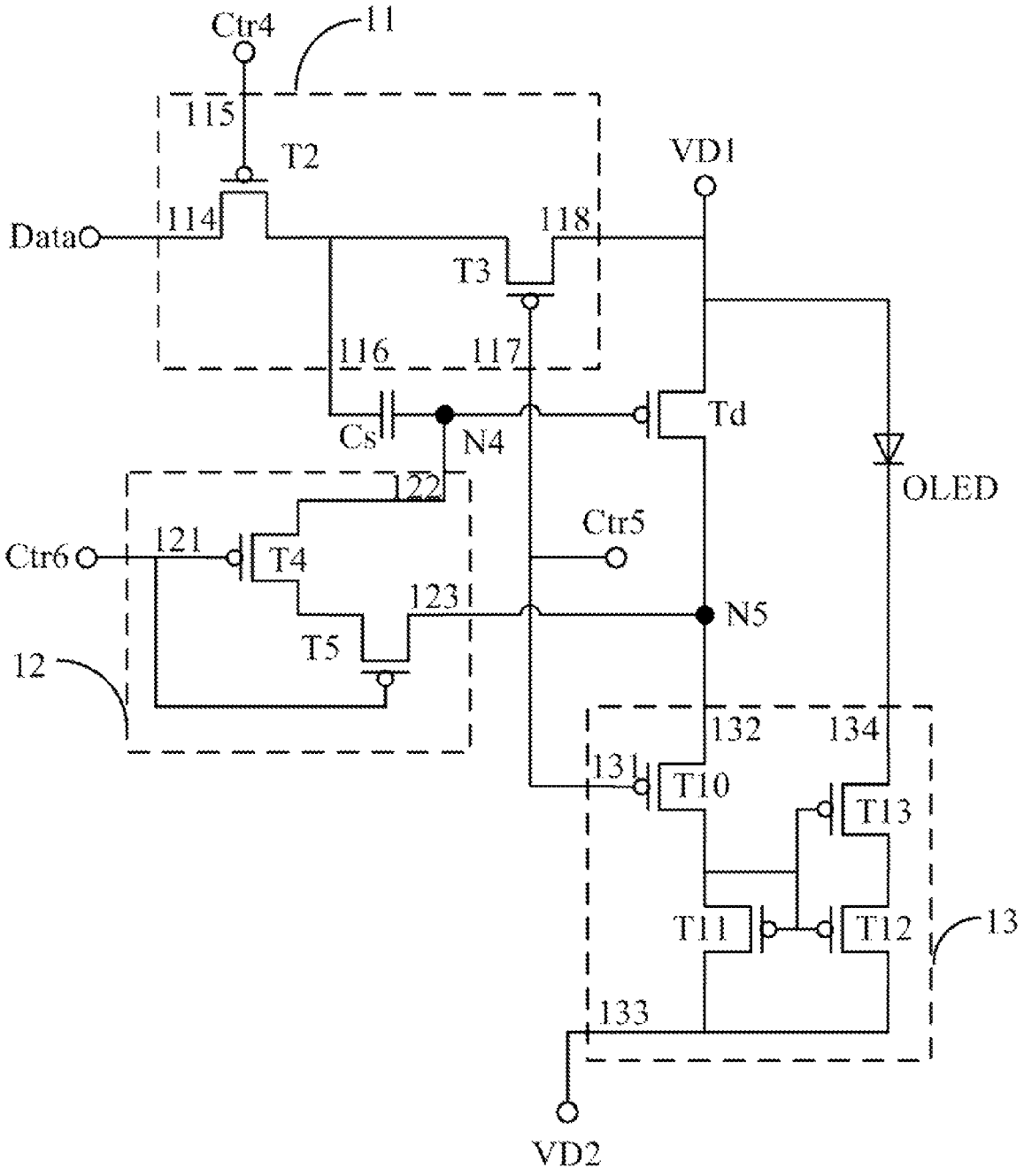
FIG. 12 is a simplified circuit diagram of a pixel circuit according to a ninth embodiment of the present invention.

As illustrated in FIG. 10 or FIG. 12, when all the transistors in the signal loading component, the compensation component and the mirror component in the pixel circuit according to the embodiment of the present invention are p-type transistors, and the drive transistor is a p-type transistor, the compensation component 12 in the pixel circuit according to the embodiment of the present invention includes a fourth transistor T4 and a fifth transistor T5, wherein a gate of the fourth transistor T4 is the first end 121 of the compensation component 12, and the sixth control signal Ctr6 is received at the first end 121, a first terminal of the fourth transistor T4 is the second end 122 of the compensation component 12, and a second terminal of the fourth transistor T4 is a first terminal of the fifth transistor T5; the gate of the fifth transistor T5 is the first end 121 of the compensation component 12, and the sixth control signal Ctr6 is received at the first end 121, and a second terminal of the fifth transistor T5 is the third end 123 of the compensation component 12; and both the fourth transistor T4 and the fifth transistor T5 are configured to be turned on in the threshold voltage compensation stage and turned off in the data transmission stage and the light emission stage.

Since there is a gate-source parasitic capacitance and a gate-drain parasitic capacitance of a transistor per se and there is also a parasitic capacitance of overlapping line segments in the pixel circuit, when the respective control signals change, a potential at the gate of the drive transistor Td may change due to a coupling effect of the capacitance, thus degrading the effect of compensation in the threshold voltage compensation stage.

Figure 11:
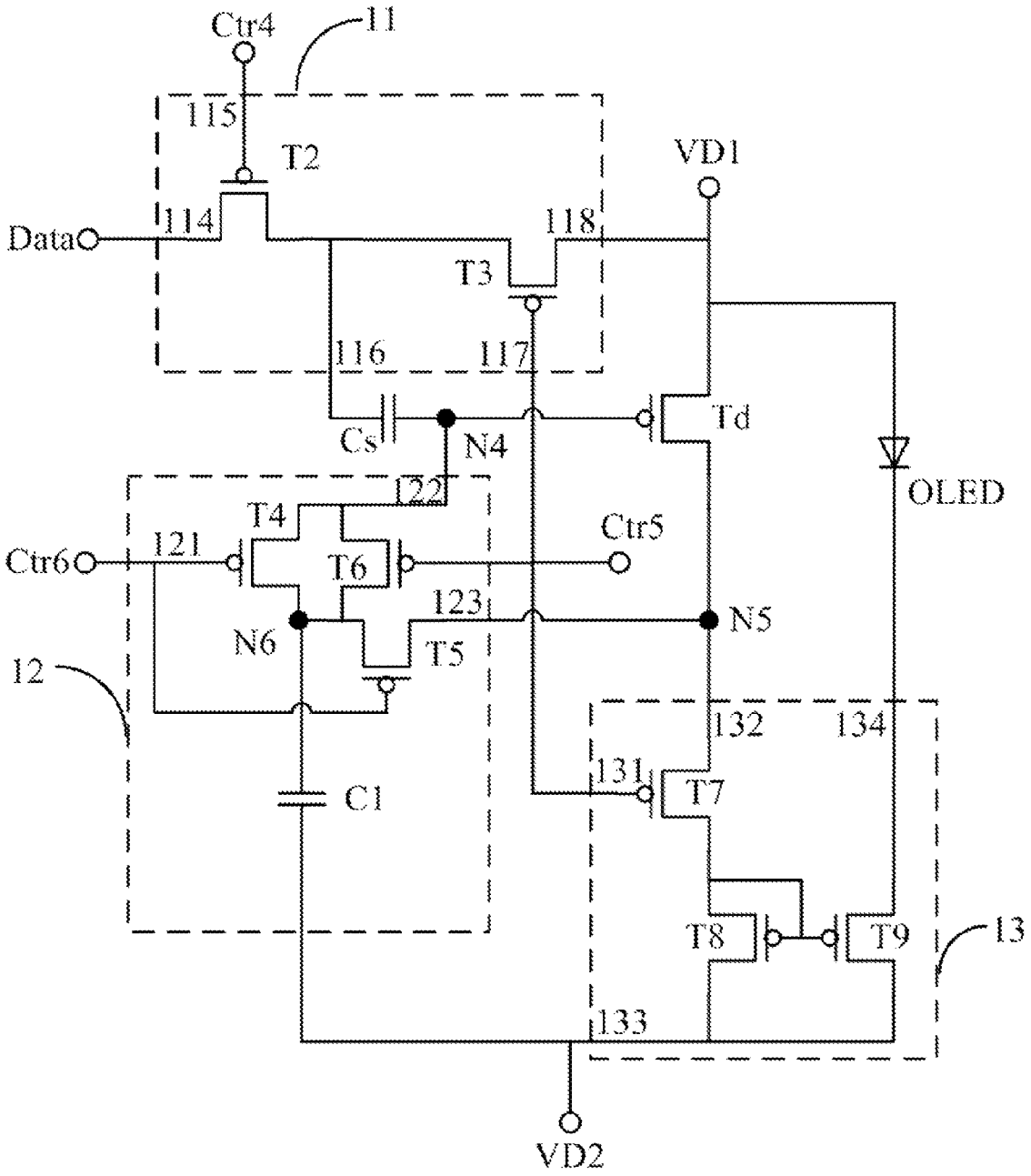
FIG. 11 is a simplified circuit diagram of a pixel circuit according to an eighth embodiment of the present invention.
Figure 13:
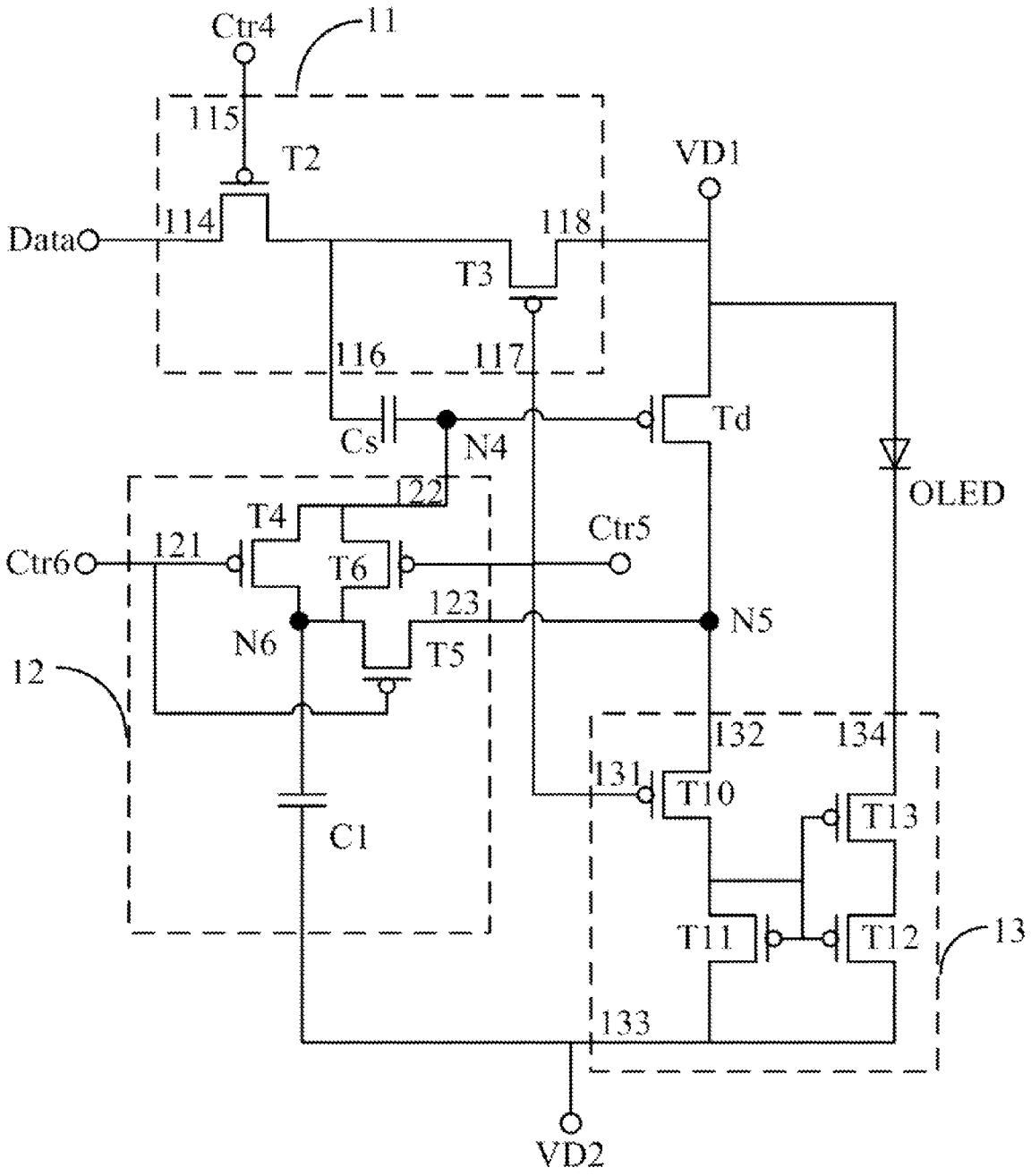
FIG. 13 is a simplified circuit diagram of a pixel circuit according to a tenth embodiment of the present invention.

Thus preferably as illustrated in FIG. 11 or FIG. 13, when all the transistors in the signal loading component, the compensation component and the mirror component in the pixel circuit according to the embodiment of the present invention are p-type transistors, and the drive transistor is a p-type transistor, the compensation component 12 in the pixel circuit according to the embodiment of the present invention further includes a sixth transistor T6 and a first capacitor C1, wherein both a first terminal of the sixth transistor T6 and one end of the first capacitor C1 are connected with the second terminal of the fourth transistor T4; the second power supply signal VD2 is received at the other end of the first capacitor C1; a signal received at the gate of the sixth transistor T6 is the same as the signal received at the first end 131 of the mirror component 13, that is, the fifth control signal Ctr5 is received at the gate of the sixth transistor T6, and a second terminal of the sixth transistor T6 is connected with the gate of the drive transistor Td; the sixth transistor T6 is turned on in the light emission stage and turned off in both the data transmission stage and the threshold voltage compensation stage, and the first capacitor C1 is charged in the threshold voltage compensation stage so that the drive transistor Td generates the drive signal from the stored image data signal.

After the sixth transistor T6 and the first capacitor C1 are added to the compensation component, in the threshold voltage compensation stage, the second power supply signal VD2 is received at one end of the first capacitor C1, and the voltage of the second power supply signal VD2 is substantially stable, so that the potential at the gate of the drive transistor Td may be locked effectively, thus the potential at the gate of the drive transistor Td will not be easily changed with the variation of the respective control signals, and further make the compensated potential at the gate of the drive transistor Td be closer to a preset potential, i.e., Vdata+Vth; and when the light emission stage starts, that is, the turned-off third transistor is turned on, the first capacitor C1 may lock effectively the potential at the gate of the drive transistor Td so that it will not vary with the varying voltage at the end of the storage capacitor Cs connected with the second terminal of the second transistor T2.

Furthermore as illustrated in FIG. 10 or FIG. 11, when all the transistors in the signal loading component, the compensation component and the mirror component in the pixel circuit according to the embodiment of the present invention are p-type transistors, and the drive transistor is a p-type transistor, the mirror component in the pixel circuit according to the embodiment of the present invention includes a seventh transistor T7, an eighth transistor T8 and a ninth transistor T9, wherein a first terminal of the seventh transistor T7 is the second end 132 of the mirror component 13, the gate of the seventh transistor T7 is the first end 131 of the mirror component 13, and the fifth control signal Ctr5 is received at the first end 131, and a second terminal of the seventh transistor T7 is connected respectively with a first terminal of the eighth transistor T8, the gate of the eighth transistor T8 and the gate of the ninth transistor T9; a second terminal of the eighth transistor T8 is the third end 133 of the mirror component 13; and a first terminal of the ninth transistor T9 is the fourth end 134 of the mirror component 13, and a second terminal of the ninth transistor T9 is the third end 133 of the mirror component 13.

At this time, after the seventh transistor T7 is turned on, the current flowing through the eighth transistor T8 is the same as the current flowing through the ninth transistor T9 when the parameter of the eighth transistor T8 is the same as that of the ninth transistor T9, so the mirror component may mirror the current at the drain of the drive transistor Td onto the organic light emitting diode so as to drive the Organic Light Emitting Diode (OLED) to emit light.

Preferably when all the transistors in the signal loading component, the compensation component and the mirror component in the pixel circuit according to the embodiment of the present invention are p-type transistors, and the drive transistor is a p-type transistor, the mirror component in the pixel circuit according to the embodiment of the present invention is further configured to perform negative feedback control on the current flowing through the organic light emitting diode to stabilize the current flowing through the organic light emitting diode.

At this time, as illustrated in FIG. 12 or FIG. 13, the mirror component in the pixel circuit according to the embodiment of the present invention includes a tenth transistor T10, an eleventh transistor T11, a twelfth transistor T12 and a thirteenth transistor T13, wherein a first terminal of the tenth transistor T10 is the second end 132 of the mirror component 13, the gate of the tenth transistor T10 is the first end 131 of the mirror component 13, and the fifth control signal Ctr5 is received at the first end 131, and a second terminal of the tenth transistor T10 is connected respectively with a first terminal of the eleventh transistor T11, the gate of the eleventh transistor T11, the gate of the twelfth transistor T12 and the gate of the thirteenth transistor T13; a second terminal of the eleventh transistor T11 is the third end 133 of the mirror component 13; and a first terminal of the twelfth transistor T12 is connected with a first terminal of the thirteenth transistor T13, a second terminal of the twelfth transistor T12 is the third end 133 of the mirror component 13, and a second terminal of the thirteenth transistor T13 is the fourth end 134 of the mirror component 13.

The mirror component 13 in FIG. 12 or FIG. 13 stabilizes the current flowing through the Organic Light Emitting Diode (OLED) under the same principle as the principle under which the mirror component 13 in FIG. 6 or FIG. 7 stabilizes the current flowing through the Organic Light Emitting Diode (OLED), and there is no need to repeat herein.

The first terminal of any one of the eleventh transistor T11, the twelfth transistor T12 and the thirteenth transistor T13 in FIG. 12 or FIG. 13 may be the source (or the drain) of the transistor, and the second terminal of the transistor may be the drain (or the source) of the transistor. If the source of the transistor is the first pole, then the drain of the transistor is the second pole; and if the drain of the transistor is the first pole, then the source of the transistor is the second pole.

All the second transistor T2, the third transistor T3, the fourth transistor T4, the fifth transistor T5, the sixth transistor T6, the seventh transistor T7, the eighth transistor T8, the ninth transistor T9, the tenth transistor T10, the eleventh transistor T11, the twelfth transistor T12, the thirteenth transistor T13 and the drive transistor Td in the pixel circuit illustrated in FIG. 10, FIG. 11, FIG. 12 and FIG. 13 are p-type transistors.

Figure 14:
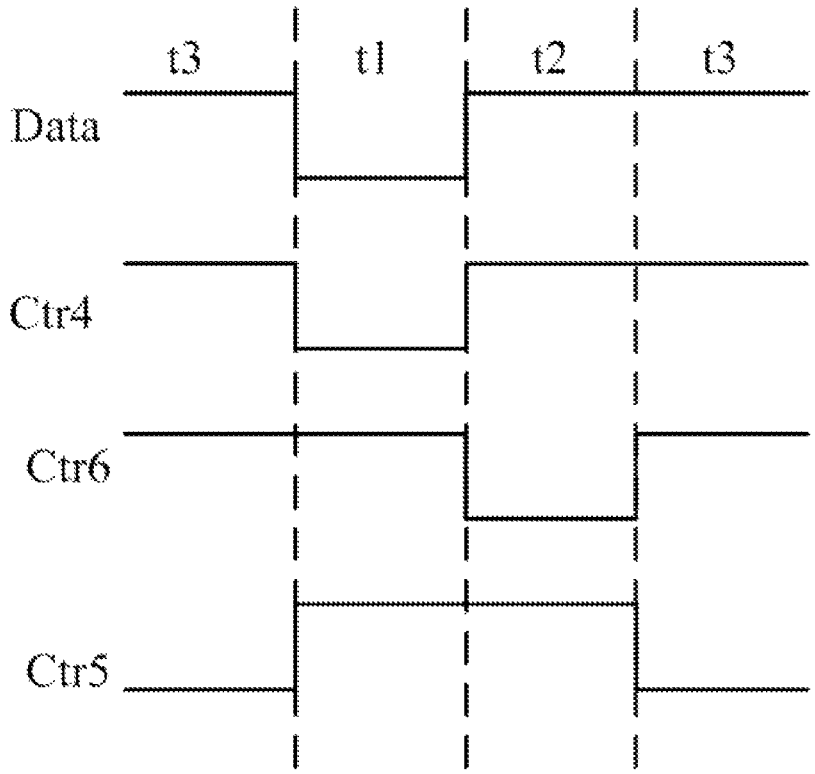
FIG. 14 is an operational timing diagram of the pixel circuits illustrated in FIG. 10 to FIG. 13.

FIG. 14 illustrates an operating timing of the pixel circuit illustrated in FIG. 10, FIG. 11, FIG. 12 and FIG. 13, wherein in the data transmission stage t1, since the fourth control signal Ctr4 is at a low level, so the second transistor T2 is turned on, and since the fifth control signal Ctr5 is at a high level, so the third transistor T3 is turned off, so that the image data signal Data may be transmitted to the gate of the drive transistor Td through the storage capacitor Cs, and stored in the storage capacitor Cs, and the voltage at the first node N1 is Vdata, i.e., the voltage of the image data signal Data; the sixth control signal Ctr6 is at a high level, so both the fourth transistor T4 and the fifth transistor T5 are turned off; and the fifth control signal Ctr5 is at a high level, so the sixth transistor T6 in FIG. 11 and FIG. 13 is turned off, the seventh transistor T7 in FIG. 10 and FIG. 11 is turned off, and the tenth transistor T10 in FIG. 12 and FIG. 13 is turned off.

In the threshold voltage compensation stage t2, the fourth control signal Ctr4 is at a high level, so the second transistor T2 is turned off, and the fifth control signal Ctr5 is at a high level, so the third transistor T3 is turned off; the sixth control signal Ctr6 is at a high level, so both the fourth transistor T4 and the fifth transistor T5 are turned on so that the gate of the drive transistor Td is connected to the source of the drive transistor Td, and the voltage at the fourth node N4, the voltage at the fifth node N5 and the voltage at the sixth node N6 are equal and are all equal to Vdata+Vth, wherein Vth represents the threshold voltage of the drive transistor; and the fifth control signal Ctr5 is at a high level, so the sixth transistor T6 in FIG. 11 and FIG. 13 is turned off, the seventh transistor T7 in FIG. 10 and FIG. 11 is turned off, and the tenth transistor T10 in FIG. 12 and FIG. 13 is turned off.

In the light emission stage t3, the fourth control signal Ctr4 is at a high level, so the second transistor T2 is turned off, and the fifth control signal Ctr5 is at a low level, so the third transistor T3 is turned on, and the one end of the storage capacitor Cs does not float any longer but the first power supply signal VD1 is received at that end; the sixth control signal Ctr6 is at a high level, so both the fourth transistor T4 and the fifth transistor T5 are turned off; and the fifth control signal Ctr5 is at a low level, so the sixth transistor T6 in FIG. 11 and FIG. 13 is turned on, the seventh transistor T7 in FIG. 10 and FIG. 11 is turned on, and the tenth transistor T10 in FIG. 12 and FIG. 13 is turned on, so that the Organic Light Emitting Diode (OLED) emits light.

Figure 15:
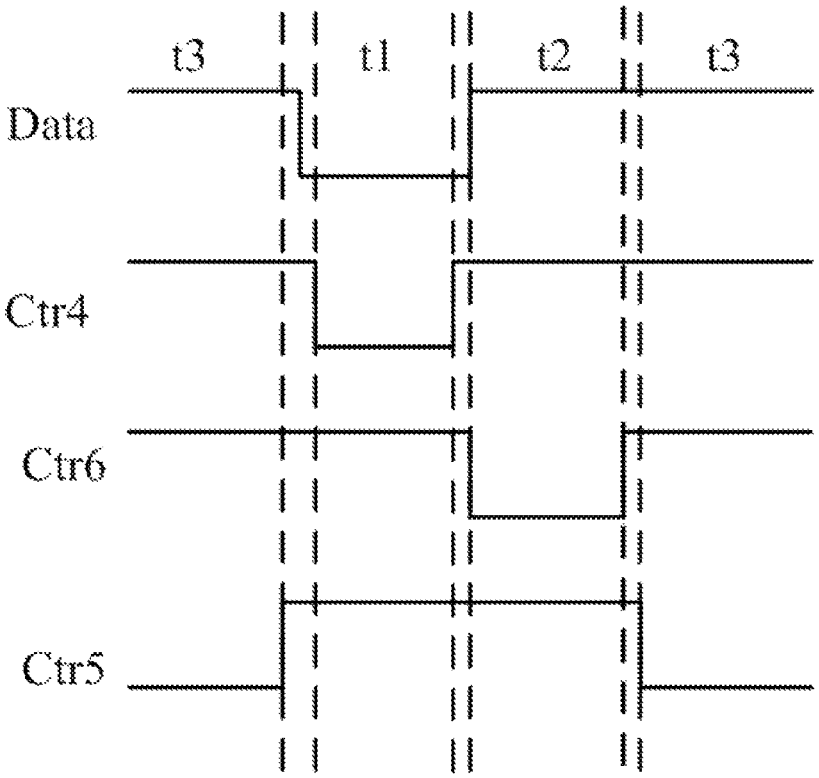
FIG. 15 is an operational timing diagram of the pixel circuits illustrated in FIG. 10 to FIG. 13.

Of course, the operating timing of the pixel circuit illustrated in FIG. 10, FIG. 11, FIG. 12 and FIG. 13 may alternatively be as illustrated in FIG. 15, wherein the fourth control signal Ctr4 will not be changed to a low level until the fifth control signal Ctr5 is changed to a high level so that the Organic Light Emitting Diode (OLED) may be ensured not to transmit the current frame of image data signal to the gate of the drive transistor Td until it stops from emitting light; in FIG. 15, the fourth control signal Ctr4 will not be changed to a high level until the image data signal becomes the current frame of image data, so that the current frame of image data signal may be ensured not to be transmitted to the gate of the drive transistor Td until it becomes stable; moreover, the sixth control signal Ctr6 will not be changed to a low level until the fourth control signal Ctr4 is changed to a high level, so that threshold voltage compensation may be ensured not to be performed until the second transistor T2 is turned off, and thus the second transistor T2 may be avoided from transmitting the signal to the gate of the drive transistor Td during threshold voltage compensation; and lastly, the fifth control signal Ctr5 will not be changed to a low level until the sixth control signal Ctr6 is changed to a high level, so that the gate of the drive transistor Td may be ensured to be disconnected from the source of the drive transistor Td when the Organic Light Emitting Diode (OLED) is driven to emit light.

An embodiment of the present invention further provides a pixel circuit for driving an organic light emitting diode, the pixel circuit including a first transistor, a second transistor, a third transistor, a fourth transistor, a fifth transistor, a sixth transistor, a drive transistor and a storage capacitor, wherein the first transistor includes a first terminal at which an image data signal is received, the gate at which a first control signal is received, and a second terminal connected respectively with the gate of the drive transistor and one end of the storage capacitor; the second transistor includes a first terminal connected with the gate of the drive transistor, the gate at which a second control signal is received, and a second terminal connected with a first terminal of the third transistor; the third transistor includes the gate at which the second control signal is received, and a second terminal connected with the source of the drive transistor; the drive transistor includes the drain at which a first power supply signal is received; the fourth transistor includes a first terminal connected with the source of the drive transistor, the gate at which the third control signal is received, and a second terminal connected respectively with a first terminal of the fifth transistor, the gate of the fifth transistor and the gate of the sixth transistor, the fifth transistor includes a second terminal at which a second power supply signal is received; the sixth transistor includes a first terminal connected with the cathode of the organic light emitting diode, and a second terminal at which a second power supply signal is received; and the storage capacitor includes the other end at which the first power supply signal is received.

At this time the first transistor is T1 in FIG. 4, the second transistor is T4 in FIG. 4, the third transistor is T5 in FIG. 4, the drive transistor is Td in FIG. 4, the fourth transistor is T7 in FIG. 4, the fifth transistor is T8 in FIG. 4, the sixth transistor is T9 in FIG. 4, the storage capacitor is Cs in FIG. 4, and the organic light emitting diode is the OLED in FIG. 4.

Optionally, the pixel circuit according to the embodiment of the present invention further includes a seventh transistor and a first capacitor, wherein the seventh transistor includes a first terminal connected with the second terminal of the second transistor, a gate at which the third control signal is received, and a second terminal connected with the gate of the drive transistor, and the first capacitor includes one end connected with the second terminal of the second transistor, and the other end at which the second power supply signal is received.

At this time, the seventh transistor is T6 in FIG. 5, and the first capacitor is C1 in FIG. 5.

Optionally, the pixel circuit according to the embodiment of the present invention further includes an eighth transistor, wherein the first terminal of the sixth transistor is connected with the cathode of the organic light emitting diode through the eighth transistor, and the gate of the eighth transistor is connected with the second terminal of the fourth transistor.

At this time, the fourth transistor is T10 in FIG. 6 or FIG. 7, the fifth transistor is T11 in FIG. 6 or FIG. 7, the sixth transistor is T12 in FIG. 6 or FIG. 7, and the eighth transistor is T13 in FIG. 6 or FIG. 7.

An embodiment of the present invention further provides a pixel circuit for driving an organic light emitting diode, the pixel circuit including a first transistor, a second transistor, a third transistor, a fourth transistor, a fifth transistor, a sixth transistor, a seventh transistor, a drive transistor and a storage capacitor.

The first transistor includes a first terminal at which an image data signal is received, the gate at which a fourth control signal is received, and a second terminal connected respectively with a first terminal of the second transistor and one end of the storage capacitor.

The second transistor includes the gate at which a fifth control signal is received, and a second terminal connected with the drain of the drive transistor.

The storage capacitor includes the other end connected with the gate of the drive transistor.

The third transistor includes a first terminal connected with the gate of the drive transistor, the gate at which a sixth control signal is received, and a second terminal connected with a first terminal of the fourth transistor.

The fourth transistor includes the gate at which the sixth control signal is received, and a second terminal connected with the source of the drive transistor.

The drive transistor includes the drain at which a first power supply signal is received.

The fifth transistor includes a first terminal connected with the source of the drive transistor, the gate at which the fifth control signal is received, and a second terminal connected respectively with a first terminal of the sixth transistor, the gate of the sixth transistor and the gate of the seventh transistor.

The sixth transistor includes a second terminal at which a second power supply signal is received.

The seventh transistor includes a first terminal connected with the cathode of the organic light emitting diode, and a second terminal at which the second power supply signal is received.

At this time, the first transistor is T2 in FIG. 10, the second transistor is T3 in FIG. 10, the storage capacitor is Cs in FIG. 10, the third transistor is T4 in FIG. 10, the fourth transistor is T5 in FIG. 10, the drive transistor is Td in FIG. 10, the fifth transistor is T7 in FIG. 10, the sixth transistor is T8 in FIG. 10, the seventh transistor is T9 in FIG. 10, and the organic light emitting diode is the OLED in FIG. 10.

Optionally, the pixel circuit according to the embodiment of the present invention further includes an eighth transistor and a first capacitor, where the eighth transistor includes a first terminal connected with a second terminal of the third transistor, the gate at which a fifth control signal is received, and a second terminal connected with the gate of the drive transistor; and the first capacitor includes one end connected with a second terminal of the third transistor, and the other end at which the second power supply signal is received.

At this time the eighth transistor is T6 in FIG. 11, and the first capacitor is C1 in FIG. 11.

Optionally, the pixel circuit according to the embodiment of the present invention further includes a ninth transistor, wherein a first terminal of the seventh transistor is connected with the cathode of the organic light emitting diode through the ninth transistor, and the gate of the ninth transistor is connected with a second terminal of the fifth transistor.

At this time, the fifth transistor is T10 in FIG. 12 or FIG. 13, the sixth transistor is T11 in FIG. 12 or FIG. 13, the seventh transistor is T12 in FIG. 12 or FIG. 13, and the ninth transistor is T13 in FIG. 12 or FIG. 13.

The first terminal of the transistor as referred to in the embodiment of the present invention may be the source (or the drain) of the transistor, and the second terminal of the transistor may be the drain (or the source) of the transistor.

If the source of the transistor is the first pole, then the drain of the transistor is the second pole; and if the drain of the transistor is the first pole, then the source of the transistor is the second pole. The connection s referred to in the embodiment of the present invention includes a physical connection and an electrical connection.

Figure 16:
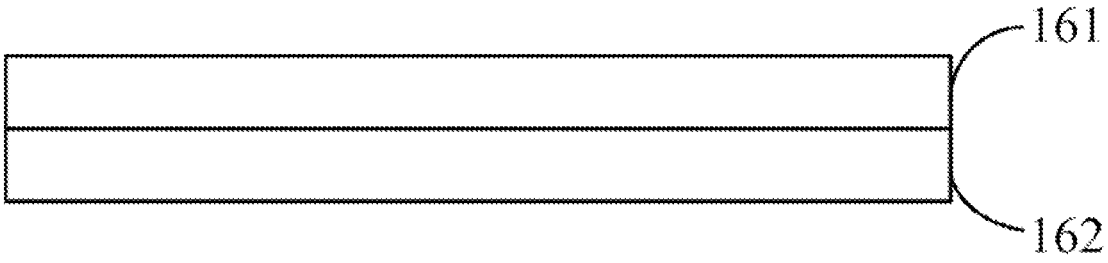
FIG. 16 is a simplified block diagram of a display panel according to an embodiment of the present invention.

An embodiment of the present invention provides a display panel, as illustrated in FIG. 16, including a pixel circuit 61 according to any one of the embodiments above of the present invention and an array substrate 162.

When the display panel includes the plurality of pixel circuits, the first control signal, the second control signal and the third control signal received by each of the pixel circuits may come from different signal sources or may be derived from a signal outputted by the same signal source.

Similarly, when the display panel includes the plurality of pixel circuits, the fourth control signal, the fifth control signal and the sixth control signal received by each of the pixel circuits may come from different signal sources or may be derived from a signal outputted by the same signal source.

Figure 17:
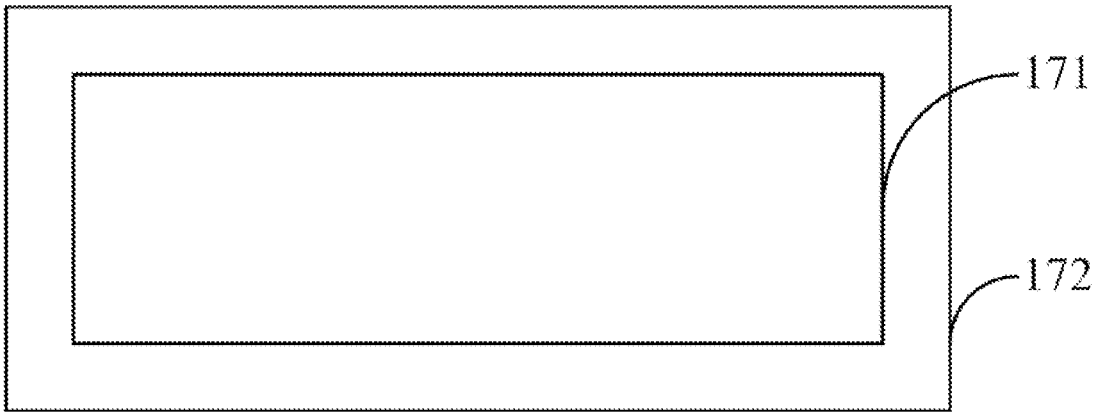
FIG. 17 is a simplified block diagram of a display device according to an embodiment of the present invention.

An embodiment of the present invention provides a display device, as illustrated in FIG. 17, including the display panel 171 according to the embodiment of the present invention and a housing 172 of the display device.

Those skilled in the art may appreciate that the drawings are merely simplified block and circuit diagrams of preferred embodiments of the present invention and not all of the components or flows in the drawings are necessarily necessary for the present invention to be put into practice.

Those skilled in the art may appreciate that the components in the devices according to the embodiments may be distributed in the devices of the embodiments as described in the embodiments or located in one or more other devices than the embodiments in question while being adapted correspondingly. The components in the foregoing embodiments may be integrated into a component or subdivided into a plurality of sub-components.

The foregoing embodiments of the present invention have been numbered merely for the convenience of their description but will not indicate any precedence of one embodiment over the other.

Evidently those skilled in the art may make various modifications and variations to the present invention without departing from the spirit and scope of the present invention. Thus the present invention is also intended to encompass these modifications and variations thereto so long as the modifications and variations come into the scope of the claims appended to the present invention and their equivalents.

What is claimed is:

1. A pixel circuit for driving an organic light emitting diode, the pixel circuit comprising a signal loading component, a storage capacitor, a compensation component, a mirror component, and a drive transistor, wherein the signal loading component comprises a first end configured to receive an image data signal, a second end configured to receive a first control signal, and a third end configured to connect with a gate of the drive transistor;

the storage capacitor comprises a first end connected with a drain of the drive transistor and a second end connected with the gate of the drive transistor;

the drive transistor is configured to generate current at the drain thereof according to a difference between a signal at the gate thereof and a signal at a source thereof in a light emission stage, wherein the drain of the drive transistor is configured to receive a first power supply signal;

the compensation component comprises a first end configured to receive a second control signal, a second end connected with the gate of the drive transistor, and a third end connected with the source of the drive transistor;

the mirror component comprises a first end configured to receive a third control signal, a second end connected with the source of the drive transistor, a third end configured to receive a second power supply signal, and a fourth end connected with a cathode of the organic light emitting diode; and the organic light emitting diode comprises an anode configured to receive the first power supply signal.

2. The pixel circuit according to claim 1, wherein the signal loading component is configured to transmit the image data signal to the gate of the drive transistor in a data transmission stage;

the storage capacitor is configured to store the signal at the gate of the drive transistor;

the compensation component is configured to connect the gate of the drive transistor to the source of the drive transistor in a threshold voltage compensation stage to generate a drive signal from the image data signal stored in the storage capacitor in the data transmission stage; and the mirror component is configured to mirror the current generated by the drive transistor at the drain thereof into the organic light emitting diode in the light emission stage, such that the organic light emitting diode emits light with a difference in voltage between the first power supply signal and the second power supply signal.

3. The pixel circuit according to claim 1, wherein the first end of the signal loading component is connected to the third end of the signal loading component in the data transmission stage;

the second end of the compensation component is connected to the third end of the compensation component in the threshold voltage compensation stage to generate the drive signal from the image data signal stored in the storage capacitor; and the second end of the mirror component is connected to the third end of the mirror component in the light emission stage.

4. The pixel circuit according to claim 1, wherein the signal loading component comprises a first transistor:

a first terminal of the first transistor is the first end of the signal loading component, the gate of the first transistor is the second end of the signal loading component, and a second terminal of the first transistor is the third end of the signal loading component; and the first transistor is turned on in the data transmission stage and turned off in the threshold voltage compensation stage and the light emission stage.

5. The pixel circuit according to claim 1, wherein the compensation component comprises a fourth transistor and a fifth transistor:

wherein a gate of the fourth transistor is the first end of the compensation component, a first terminal of the fourth transistor is the second end of the compensation component, and a second terminal of the fourth transistor is connected with a first terminal of the fifth transistor;

the gate of the fifth transistor is the first end of the compensation component, and a second terminal of the fifth transistor is the third end of the compensation component; and both the fourth transistor and the fifth transistor is configured to be turned on in the threshold voltage compensation stage and to be turned off in the data transmission stage and the light emission stage.

6. The pixel circuit according to claim 5, wherein the compensation component further comprises a sixth transistor and a first capacitor:

wherein both a first terminal of the sixth transistor and a first end of the first capacitor is connected with the second terminal of the fourth transistor;

the second power supply signal is received at a second end of the first capacitor;

a signal received at the gate of the sixth transistor is the same as the signal received at the first end of the mirror component, and a second terminal of the sixth transistor is connected with the gate of the drive transistor;

the sixth transistor is turned on in the light emission stage and turned off in both the data transmission stage and the threshold voltage compensation stage; and the first capacitor is charged in the threshold voltage compensation stage, such that the drive transistor generates the drive signal from the stored image data signal.

7. The pixel circuit according to claim 1, wherein the mirror component comprises a seventh transistor, an eighth transistor and a ninth transistor:

wherein a first terminal of the seventh transistor is the second end of the mirror component, the gate of the seventh transistor is the first end of the mirror component, and a second terminal of the seventh transistor is connected respectively with a first terminal of the eighth transistor, the gate of the eighth transistor and the gate of the ninth transistor; a second terminal of the eighth transistor is the third end of the mirror component; and a first terminal of the ninth transistor is the fourth end of the mirror component, and a second terminal of the ninth transistor is the third end of the mirror component.

8. The pixel circuit according to claim 1, wherein the mirror component is further configured to perform negative feedback control on the current flowing through the organic light emitting diode so as to stabilize the current flowing through the organic light emitting diode.

9. The pixel circuit according to claim 8, wherein the minor component comprises a tenth transistor, an eleventh transistor, a twelfth transistor and a thirteenth transistor:

wherein a first terminal of the tenth transistor is the second end of the mirror component, the gate of the tenth transistor is the first end of the mirror component, and a second terminal of the tenth transistor is connected respectively with a first terminal of the eleventh transistor, the gate of the eleventh transistor, the gate of the twelfth transistor and the gate of the thirteenth transistor;

a second terminal of the eleventh transistor is the third end of the mirror component; and a first terminal of the twelfth transistor is connected with a first terminal of the thirteenth transistor, second terminal of the twelfth transistor is the third end of the mirror component, and a second terminal of the thirteenth transistor is the fourth end of the mirror component.

10. A display panel comprising a plurality of pixel elements, each of the pixel elements comprising an organic light emitting diode and a pixel circuit according to claim 1 for driving the organic light emitting diode.

11. A pixel circuit for driving an organic light emitting diode, the pixel circuit comprising a signal loading component, a storage capacitor, a compensation component, a mirror component, and a drive transistor, wherein the signal loading component comprises a fourth end configured to receive an image data signal, a fifth end configured to receive a fourth control signal, a sixth end connected with a first end of the storage capacitor, a seventh end configured to receive a fifth control signal, an eighth end connected with a drain of the drive transistor;

the compensation component comprises a first end configured to receive a sixth control signal, a second end connected with a gate of the drive transistor, and a third end connected with a source of the drive transistor;

the mirror component comprises a first end configured to receive the fifth control signal, a second end connected with the source of the drive transistor, a third end configured to receive a second power supply signal, and a fourth end connected with a cathode of the organic light emitting diode;

the storage capacitor comprises the first end connected with the sixth end of the signal loading component, and a second end connected with the gate of the drive transistor;

the drive transistor is configured to generate a current at the drain thereof according to a difference between a signal at the gate thereof and a signal at the source thereof in a light emission stage, wherein the drain of the drive transistor is configured to receive a first power supply signal; and the organic light emitting diode comprises an anode configured to receive the first power supply signal, and the cathode connected with the fourth end of the mirror component.

12. The pixel circuit according to claim 11, wherein the signal loading component is configured to transmit the image data signal to the gate of the drive transistor in a data transmission stage;

the compensation component is configured to connect the gate of the drive transistor to the source of the drive transistor in a threshold voltage compensation stage to generate a drive signal from the image data signal stored in the storage capacitor in the data transmission stage;

the mirror component is configured to mirror the current generated by the drive transistor at the drain thereof into the organic light emitting diode in the light emission stage, such that the organic light emitting diode emits light with a difference in voltage between the first power supply signal and the second power supply signal; and the storage capacitor is configured to store the signal at the gate of the drive transistor.

13. The pixel circuit according to claim 11, wherein the fourth end of the signal loading component is connected to the sixth end of the signal loading component in the data transmission stage, and disconnected from the sixth end of the signal loading component in the threshold voltage compensation stage and in the light emission stage, the sixth end of the signal loading component is disconnected from the eighth end of the signal loading component in the data transmission stage and in the threshold voltage compensation stage and connected to the eighth end of the signal loading component in the light emission stage;

the second end of the compensation component is connected to the third end of the compensation component in the threshold voltage compensation stage so as to generate the drive signal from the image data signal stored in the storage capacitor; and the second end of the mirror component is connected to the third end of the mirror component in the light emission stage.

14. The pixel circuit according to claim 11, wherein the signal loading component comprises a second transistor and a third transistor:

wherein a first terminal of the second transistor is the fourth end of the signal loading component, the gate of the second transistor is the fifth end of the signal loading component, and the second terminal of the second transistor is the sixth end of the signal loading component; and a first terminal of the third transistor is the sixth end of the signal loading component, the gate of the third transistor is the seventh end of the signal loading component, and a second terminal of the third transistor is the eighth end of the signal loading component;

the second transistor is turned on in the data transmission stage and turned off in the threshold voltage compensation stage and the light emission stage; and the third transistor is turned on in the light emission stage and turned off in the data transmission stage and the threshold voltage compensation stage.

15. The pixel circuit according to claim 11, wherein the compensation component comprises a fourth transistor and a fifth transistor:

wherein a gate of the fourth transistor is the first end of the compensation component, a first terminal of the fourth transistor is the second end of the compensation component, and a second terminal of the fourth transistor is connected with a first terminal of the fifth transistor; and the gate of the fifth transistor is the first end of the compensation component, and a second terminal of the fifth transistor is the third end of the compensation component; and both the fourth transistor and the fifth transistor are configured to be turned on in the threshold voltage compensation stage and to be turned off in the data transmission stage and the light emission stage.

16. The pixel circuit according to claim 15, wherein the compensation component further comprises a sixth transistor and a first capacitor:

wherein both a first terminal of the sixth transistor and a first end of the first capacitor is connected with the second terminal of the fourth transistor;

the second power supply signal is received at a second end of the first capacitor;

a signal received at the gate of the sixth transistor is the same as the signal received at the first end of the mirror component, and a second terminal of the sixth transistor is connected with the gate of the drive transistor;

the sixth transistor is turned on in the light emission stage and turned off in both the data transmission stage and the threshold voltage compensation stage; and the first capacitor is charged in the threshold voltage compensation stage, such that the drive transistor generates the drive signal from the stored image data signal.

17. The pixel circuit according to claim 11, wherein the mirror component comprises a seventh transistor, an eighth transistor and a ninth transistor:

wherein a first terminal of the seventh transistor is the second end of the mirror component, the gate of the seventh transistor is the first end of the mirror component, and a second terminal of the seventh transistor is connected respectively with a first terminal of the eighth transistor, the gate of the eighth transistor and the gate of the ninth transistor; a second terminal of the eighth transistor is the third end of the mirror component; and a first terminal of the ninth transistor is the fourth end of the mirror component, and a second terminal of the ninth transistor is the third end of the mirror component.

18. The pixel circuit according to claim 11, wherein the mirror component is further configured to perform negative feedback control on the current flowing through the organic light emitting diode so as to stabilize the current flowing through the organic light emitting diode.

19. The pixel circuit according to claim 18, wherein the minor component comprises a tenth transistor, an eleventh transistor, a twelfth transistor and a thirteenth transistor:

wherein a first terminal of the tenth transistor is the second end of the mirror component, the gate of the tenth transistor is the first end of the mirror component, and a second terminal of the tenth transistor is connected respectively with a first terminal of the eleventh transistor, the gate of the eleventh transistor, the gate of the twelfth transistor and the gate of the thirteenth transistor;

a second terminal of the eleventh transistor is the third end of the mirror component; and a first terminal of the twelfth transistor is connected with a first terminal of the thirteenth transistor, second terminal of the twelfth transistor is the third end of the mirror component, and a second terminal of the thirteenth transistor is the fourth end of the mirror component.

20. A display panel comprising a plurality of pixel elements, each of the pixel elements comprising an organic light emitting diode and a pixel circuit according to claim 11 for driving the organic light emitting diode.

* * * * *